US005509655A

United States Patent [19]

Ugawa

[11] Patent Number: 5,509,655

[45] Date of Patent: Apr. 23, 1996

[54] FLIPPED BALL GAME APPARATUS

[75] Inventor: Shohachi Ugawa, Gunma, Japan

[73] Assignee: Kabushiki Kaisha Sankyo, Gunma, Japan

[21] Appl. No.: 312,738

[22] Filed: Sep. 27, 1994

[30] Foreign Application Priority Data

Sep. 30, 1993 [JP] Japan ..... 5-245233

[51] Int. Cl.[6] ..... A63F 7/30

[52] U.S. Cl. ..... 273/121 B; 273/118 A; 273/119 A; 273/120 A; 273/121 A; 273/122 A; 273/123 A; 273/124 A; 273/125 A

[58] Field of Search ..... 273/121–125

[56] References Cited

U.S. PATENT DOCUMENTS 5,031,911 7/1991 Okada ..... 273/121 B
5,131,655 7/1992 Ugawa .

FOREIGN PATENT DOCUMENTS 53-83839 7/1978 Japan .
53-85639 7/1978 Japan .
53-74937 7/1978 Japan .
53-83838 7/1978 Japan .
59-192381 10/1984 Japan .
1-254183 10/1989 Japan .
4-322677 11/1992 Japan .
4-357972 12/1992 Japan .
5-237234 9/1993 Japan .

*Primary Examiner*—Raleigh W. Chiu
*Attorney, Agent, or Firm*—Lowe, Price, LeBlanc & Becker

[57] ABSTRACT

The present invention includes a ball shooting mechanism for shooting a PACHINKO ball into a play field, a variable display apparatus capable of variably displaying a plural kinds of identification information, and a starting condition determining means for determining satisfaction of game starting conditions satisfied under such conditions that a coin is deposited and the like in accordance with manipulation of a start button by a player. In response to a determination output of the starting condition determining means, the ball shooting mechanism is driven and controlled to automatically shoot a ball, and the variable display apparatus is, after variation of display thereof is started, is controlled to be stopped so as to draw and display a display result thereof.

39 Claims, 22 Drawing Sheets

FLIPPED BALL GAME APPARATUS

BACKGROUND OF THE INVENTION

1. Field of the Invention

The present invention relates to a flipped ball game apparatus having a play field into which balls are flipped to play a game.

2. Description of the Background Art

A game machine called a pinball game machine has conventionally being proposed. This pinball game machine has a play field in which balls move down and a player plays a game by using the rolling balls. When the balls rolling down in the play field collide with certain obstacles, the balls are flipped and captured at indefinite probabilities while tracing their irregularly changing trajectories, and consequently a predetermined reward is provided to the player.

A conventional pinball game of particular interest to the present invention is a Japanese pinball game of the type called PACHINKO which has been popular in Japan.

Although the present invention is not limited to such a PACHINKO game machine, it is most widely applicable to the PACHINKO game machine.

A large number of such PACHINKO game machine are installed in a game house, and the player goes to the game house and plays a game by using at least one of the PACHINKO game machine. In the game house, the player first buys a plurality of small balls (PACHINKO balls) and insert them into the PACHINKO game machine for playing a game. The inserted balls are flipped one by one into a play field in the machine by the player's manual operation. A number of protruding obstructive pins are standing in the play field. The flipped balls fall down tracing their irregularly changing trajectories while colliding with the obstructive pins. In the play field are further provided winning holes which are one example of a winning zone and into which the rolling balls fall at indefinite probabilities. If any one of the balls falls into any one of the winning holes, then a predetermined prize ball is paid out to the player. The player flips the prize ball again into the play field, so that he or she can play the game again. The player can also preserve a large number of such prize balls and exchange them for some prizes prepared in the game house. The player can acquire prizes of his or her selection if winning the game in the PACHINKO game machine.

FIGS. 18–20 illustrate a PACHINKO game machine which is one example of a conventional flipped ball game apparatus. FIG. 18 is an overall front view of the conventional PACHINKO game machine. FIG. 19 is an overall rear view showing the internal structure of part of the conventional PACHINKO game machine. FIG. 20 is a perspective view showing a ball flipper of the conventional PACHINKO game machine. The conventional PACHINKO game machine is disclosed in, for example, Japanese Patent Laying-Open No. 1-254183.

Referring to FIG. 18, a door supporting frame 404 is mounted on a front frame 403 serving as a member consisting a PACHINKO pinball game machine 401. A glass door frame 495 incorporating a glass plate is attached rotatably on door supporting frame 404. This glass door frame 495 opens/closes a play field 400 formed on the front face of a play board 406. This play field is a field in which flipped PACHINKO balls fall down leaving certain trajectories. A play value which is predetermined at a certain probability in accordance with the trajectories of the balls in the play field is provided to a player.

A front plate 421 is provided beneath glass door frame 495. A flipped-ball supplying tray 415 is provided on the front face of front plate 421. This supply tray 415 has such a form that PACHINKO balls can temporarily be stored therein.

In a game play, the player first deposits coins into a PACHINKO ball lending machine installed in a predetermined place in a game house and borrows PACHINKO balls by conducting a predetermined operation for the machine. Then, the player deposits the lent PACHINKO balls into supply tray 415. The player then holds and turns by his/her right hand a flipping operation handle 420 provided in a lower part of PACHINKO ball game machine 301. With the turning operation of handle 420, the PACHINKO balls stored in supply tray 415 are flipped into play field 400 one by one by action of a ball shooting apparatus 405 (see FIG. 19).

A variable display apparatus 407 is mounted in a central position of play field 400, and a variable winning ball apparatus 429 is disposed beneath variable display apparatus 407. Variable display apparatus 407 can variably display plural types of identification information formed in numerals, designs, symbols and so on. Variable winning ball apparatus 429 is set such that when PACHINKO balls fall into variable winning ball apparatus 429, a predetermined play value is supplied to the player. Variable winning ball apparatus 429 can alternate between a first state which is advantageous for the player and a second state which is disadvantageous for the player. If any of the PACHINKO balls flipped into play field 400 by operation of shooting operation handle 420 falls into any of starting winning holes 431*a*, 431*b*, and 431*c* being one example of a starting passage hole, then variable display apparatus 407 starts variation of the display. After a certain time period has elapsed, the varying display of variable display apparatus 407 is stopped. A winning hole is a ball receiving port which allows the ball flipped into the play field to fall and enter into. The winning hole is set such that when the balls are received, a predetermined play value is supplied to the player and that the received balls may be guided to a rear face of play board 406. A passage hole is a hole which allows the balls flipped into the play field to fall and enter into. The passage hole is set such that a predetermined play value can be supplied to the player by entrance of the balls into the passage hole. The balls that have entered into the passage hole are divided into two types: the one is guided to the rear face of play board 406, and the other passes through the hole and then is discharged again into play field 400. In other words, the "passage" is a broad concept including the concept of "winning". The starting winning hole is one type of winning holes, which is set to start the operation of variable display apparatus 407 (or variable winning ball apparatus 429 in some cases) as well as supply a predetermined play value to the player when the PACHINKO ball flipped into the play field falls into the starting winning hole.

If the result of the display provided when variable display apparatus 407 stops provides a predetermined specific combination of identification information (e.g., 777), an opening/closing plate 430 of variable winning ball apparatus 429 is opened, so that a state where a play value can be supplied to the player, i.e., a big hit state is generated. Normal winning holes 432 and 433 are further provided in play field 400. When PACHINKO balls fall into normal winning hole 432, 433 or variable winning ball apparatus 429, a predetermined number of prize balls are paid out through a prize ball outlet 416 into supply tray 415, so that a play value is supplied to the player. The prize ball is a PACHINKO ball serving as the play value which is supplied to the player due such as to the winning of a flipped ball. If supply tray 415 is filled with prize balls and can no longer store any balls therein, surplus prize balls are paid out through a surplus prize ball outlet 423 into a surplus prize ball receiving tray 422. A lost ball port 433 serves to collect lost balls, which are the PACHINKO balls flipped into play field 400 and having fallen down without falling into any winning holes or winning ball apparatuses. A mounting member 419 serves to mount a ball shooting apparatus 405 onto front frame 3.

Referring to FIG. 19, ball shooting apparatus 405 is provided at the lower part of PACHINKO ball game machine 401. This ball shooting apparatus 405 is comprised of a ball shooting motor 451 being one example of an electric drive source, a drive vane 452 rotated by ball shooting motor 451, a lever 453 abutting against drive vane 452, a board flipping hammer unified with lever 543 and swung intermittently with rotation of driven vane 452, and a ganged ascending/descending apparatus 455 ascending/descending in gang with the intermittent swinging of ball flipping hammer 454. With ganged ascending/descending apparatus 455 ascending/descending, a ball supplying mechanism not shown is operated, so that the PACHINKO balls in supply tray 415 are supplied one by one to a ball shooting position. With drive vane 452 being rotated by a driving force of motor 451, lever 453 is pushed up, so that hammer 454 unified with lever 452 turns in a counterclockwise direction in FIG. 19. Hammer 454 is biased in a clockwise direction in FIG. 19 by a spring. As soon as the abutment between drive vane 452 and lever 453 is released, lever 453 and hammer 454 turn in the clockwise direction in FIG. 19. Then, the PACHINKO balls provided at the above-described ball shooting position are flipped by a tip end of hammer 454 and shot into play field 400 after having passed between an inner rail **453*a* and an outer rail 453*b* (see FIG. 18**).

The PACHINKO ball that have been shot by ball shooting apparatus 405 and then fallen into winning hole 432 are guided onto a winning ball collecting gutter 447 and then introduced into a winning ball processor 448. Winning ball processor 448 causes a prize ball dispenser 446 to operate for each winning ball, to pay out a predetermined number (e.g., 15) of prize balls. The winning balls that have passed through winning ball processor 448 are discharged outside the machine through a winning ball discharging gutter 449. The prize balls in a prize ball storing tank 443 are supplied to prize ball dispenser 446. More specifically, the prize balls in prize ball storing tank 443 are arrayed in two rows by a ball arrangement gutter 444, and then supplied into prize ball dispenser 446 through a curving gutter 445.

In the figure, a winning ball collecting cover 438 serves to guide the PACHINKO balls that have fallen into winning hole 432 onto winning ball collecting gutter 447, and also guide the PACHINKO balls that have fallen into starting winning hole **431*a* onto winning ball collecting gutter 447 after these winning balls passed through a starting winning ball detect switch 441*a*. The PACHINKO balls that have fallen into starting winning holes 431*b* and 431*c* are also detected by starting winning ball detect switches 441*b* and 441*c* and then guided onto winning ball collecting gutter 447. In the figure, a main body 440 of the variable display apparatus, a lost-ball port 434 and a solenoid 442 being one example of the electric drive source for opening/closing an opening/closing plate 430 (see FIG. 19) of variable winning ball apparatus 429 are provided. A relay base plate 439 is also provided. A control base plate box 450 for game control serves to accommodate a game control base plate which controls the opening/closing of variable winning ball apparatus 429 and the display of variable display apparatus 407**.

The ball shooting apparatus of the PACHINKO ball game machine shown in FIG. 20 is disclosed in, for example, Japanese Patent Laying-Open No. 59-192381.

A shaft 413 penetrates a mount member 419. Shaft 413 and shooting operation handle 420 are engaged with each other at the front surface of mount member 419, while a fan shaped gear 414A is attached to shaft 413 at the rear face of mount member 419.

A flipping force adjusting lever 412 is mounted on shooting operation handle 420. Flipping force adjusting lever 412 has a protrusion **412*a* on which the player's finger for turning lever 412 is hang. When the player holds this operation handle 420 by hand and hangs his or her finger on protrusion 412*a* of adjusting lever 412 to turn flipping force adjusting lever 412, shaft 413 is rotated, so that fan-shaped gear 414*a* is also rotated in the same direction. The motion of fan-shaped gear 414A is conveyed to a gear 414B and further to a gear 414C. This causes expansion of a wire 415 with its one end fixed onto gear 414C, so that a force is applied to hammer 454 which is attached to the other end of wire 415 by means of a spring 416. This enables adjustment of the PACHINKO ball flipping force of hammer 454**.

With fan-shaped gear 414A rotating as described above, an actuator 422 abutting against one end of gear 414A is driven, so that a microswitch 421 is turned on. With switch 421 turned on, motor 451 is activated, so that hammer 454 carries out a ball flipping operation.

As has been mentioned above, the conventional flipped ball game machine is structured such that balls are flipped into play field 400 by the player's manipulation of shooting operation handle 420, and a play value is supplied to the player dependently on the trajectories of the falling flipped balls. Further, the conventional flipped ball game machine is structured such that the flipping force of the balls flipped into play field 400 can be adjusted by the player's manipulation of shooting operation handle 420.

In the conventional flipped ball game machine represented by such a PACHINKO ball game machine, the player can enjoy the falling state of the balls flipped into play field 400; however, since the scores of evaluation of the game are dependent upon the player's skill of operating flipping balls, the player cannot simply enjoy chances as he or she does in slot machines, roulettes and the like.

In order to allow the player to simply enjoy chances, a flipped ball game apparatus is disclosed in, for example, U.S. Pat. No. 5,131,655. Such a flipped ball game apparatus includes a ball shooting mechanism for flipping balls into the play field, and a starting condition determining means for determining whether or not game starting conditions are satisfied under such a necessary condition that a valuable object (e.g., a coin) capable of being used in a game play and having a predetermined value is deposited, wherein the ball shooting mechanism is controlled and driven such that the balls are automatically flipped in response to a determination output from the starting condition determining means. This conventional flipped ball game machine further includes a variable display apparatus, wherein if the balls flipped into the play field enter predetermined winning zones (starting winning zones), then the varying display of the variable display apparatus is controlled to draw and display the result of the display. If the display result is provided in a predetermined specific displaying manner (e.g., 777), a large number of coins or the like are paid out so that the player can obtain a large value.

In the conventional flipped ball game machine having the above-described structure, even though the variable display apparatus is installed, the varying display of the variable display apparatus does not operate when the balls flipped into the play field do not enter the starting winning zones, such that the apparatus is not controlled to draw and display the display result. In some cases, all balls are flipped into the play field until the game is over without any control for drawing and displaying the display result of the variable display apparatus being ever carried out, which is unsatisfactory to the player.

SUMMARY OF THE INVENTION

A principle object of the present invention is therefore to provide a flipped ball game apparatus wherein a player can enjoy chances under less influence caused by the player's skill of flipping balls as well as enjoy the falling state of the balls flipped into a play field, and wherein such a disadvantage that a game is over without any control for drawing and displaying a display result of a variable display apparatus can be prevented.

Another object of the present invention is to enable a flipping force of balls, automatically flipped into a play field in a flipped ball game apparatus, to be adjusted to a desired flipping force without a flipping operation conducted by a player.

The present invention is made to provide a flipped ball game apparatus having a play field into which a ball is shot and moves leaving an indefinite trajectory, wherein a predetermined play value can be provided to a player in accordance with the trajectory of the ball moving in the play field. The flipped ball game apparatus includes: a ball shooting means for shooting a ball toward the play field; a variable display apparatus capable of varying a display state; a starting condition determining means for determining whether game starting conditions necessary to start a game are satisfied or not; a ball shooting automatically controlling means for automatically driving and controlling the ball shooting means to automatically shoot the ball when the starting condition determining means determines that the game starting conditions are satisfied; and a variable display controlling means for controlling the variable display apparatus to draw and display the display result when the starting condition determining means determines that the game starting conditions are satisfied, the ball being automatically shot into the play field and the display result of the controlled variable display apparatus being automatically drawn and displayed when the game starting conditions are satisfied.

In the flipped ball game apparatus according to the present invention, the starting condition determining means determines when the game starting conditions necessary for starting the game are satisfied. In accordance with the determination indicating that the game starting conditions are satisfied by the game starting condition determining means, the ball shooting automatically controlling means automatically drives and controls the ball shooting means to shoot a ball automatically into the play field, whereby the variable display apparatus is controlled to draw and display automatically the display result thereof.

More specifically, the variable display apparatus of the flipped ball game apparatus according to the present invention includes a plurality of variable display members capable of varying display of a plural kinds of identification information, wherein the variable display members are formed by a rotating drum having the plural kinds of identification information provided on the outer periphery thereof, and the rotating drum is driven by a motor. The ball shooting means of the flipped ball game apparatus according to the present invention includes a shooting force variably setting means capable of variably setting a shooting force to shoot a ball, wherein the shooting force variably setting means includes a first shooting force variably setting means for setting the shooting force after adjusting the shooting force in a relatively rough manner, and a second shooting force variably setting means for setting the shooting force after adjusting the shooting force in a relatively fine manner. Those first and second shooting force variably setting means respectively include an adjustment portion capable of varying the shooting force by manual operation and a shooting force fixing means for fixing the shooting force adjusted by the adjustment portion so as to avoid distortion of the shooting force.

The flipped ball game apparatus according to the present invention further includes a one-unit game allowing means for allowing a predetermined one-unit game by shooting balls within a predetermined number of balls, the balls allowed to be shot in the one-unit game being predetermined, into the play field by using a value necessary to play the one-unit game. After the balls allowed to be shot into the play field by the one-unit game allowing means are shot, the display result of the variable display apparatus is controlled to be drawn and displayed by the variable display controlling means.

The play field of the flipped ball game apparatus according to the present invention includes a winning zone into which balls can fall to win and a lost ball port serving to collect lost balls which are not fell into the winning zone. The flipped ball game apparatus further includes a winning value providing means for providing a predetermined value to the player in accordance with winning of the balls fell into the winning zone. The winning value providing means includes a remaining ball winning value providing means for providing a value to a player in accordance with winning of remaining balls if the balls remaining in the play field after the number of balls allowed to be shot by the one-unit game allowing means are shot into the play field by the ball shooting means fall into the winning zone. The remaining ball winning value providing means includes a value provision prohibiting means after elapse of a predetermined period for prohibiting provision of a value in accordance with winning of the remaining balls when a predetermined period has elapsed after the balls allowed to be shot by the one-unit game allowing means are shot by the ball shooting means so as to prohibit shooting of balls by the ball shooting means. After prohibiting provision of the value in accordance with winning of the remaining balls by the value provision prohibiting means after elapse of the predetermined period, the variable display controlling means controls to draw and display the display result of the variable display apparatus.

According to another aspect of the present invention, a flipped ball game apparatus having a play field into which a ball is shot and moves leaving an indefinite trajectory is provided. The apparatus includes a ball shooting means for shooting a ball toward the play field by using a value of a predetermined valuable object, a usage ratio of the value of the valuable object used to shoot the ball being determined in accordance with a predetermined bet number, and a play value providing means in which a providing ratio of a play value to be provided to the player as a result of a game is determined in accordance with the bet number, and a bet number setting means for setting the bet number in a predetermined value by operation of the player.

In the flipped ball game apparatus according to the present invention, the bet number of a desired value is set in accordance with operation of the player by the bet number setting means. The ball is shot toward the play field by the ball shooting means by using the value of the predetermined valuable object, wherein the usage ratio of the value of the valuable object used to shoot the ball is determined in accordance with the bet number set by the bet number setting means. The providing ratio of the play value to be provided to the player by the value providing means is determined in accordance with the bet number set by the bet number setting means.

More specifically, the bet number setting means of the flipped ball game apparatus according to the present invention includes a valuable object receiving portion for receiving a valuable object, a value detecting means for detecting a magnitude of the value of the valuable object received into the valuable object receiving portion, and a received value setting means for setting the value of the valuable object received into the valuable object receiving portion as a bet number.

The flipped ball game apparatus according to the present invention further includes a value storing means, responsive to an operation for storing in advance a value of the valuable object which is more than twice the value necessary for the one-unit game to be used in a game, for storing that value for use in the game. The bet number setting means includes a stored value drawing and setting means for drawing a part of the value stored in the value storing means so as to be set as a bet number.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will now be described in detail with reference to the drawings.

Figure 1:
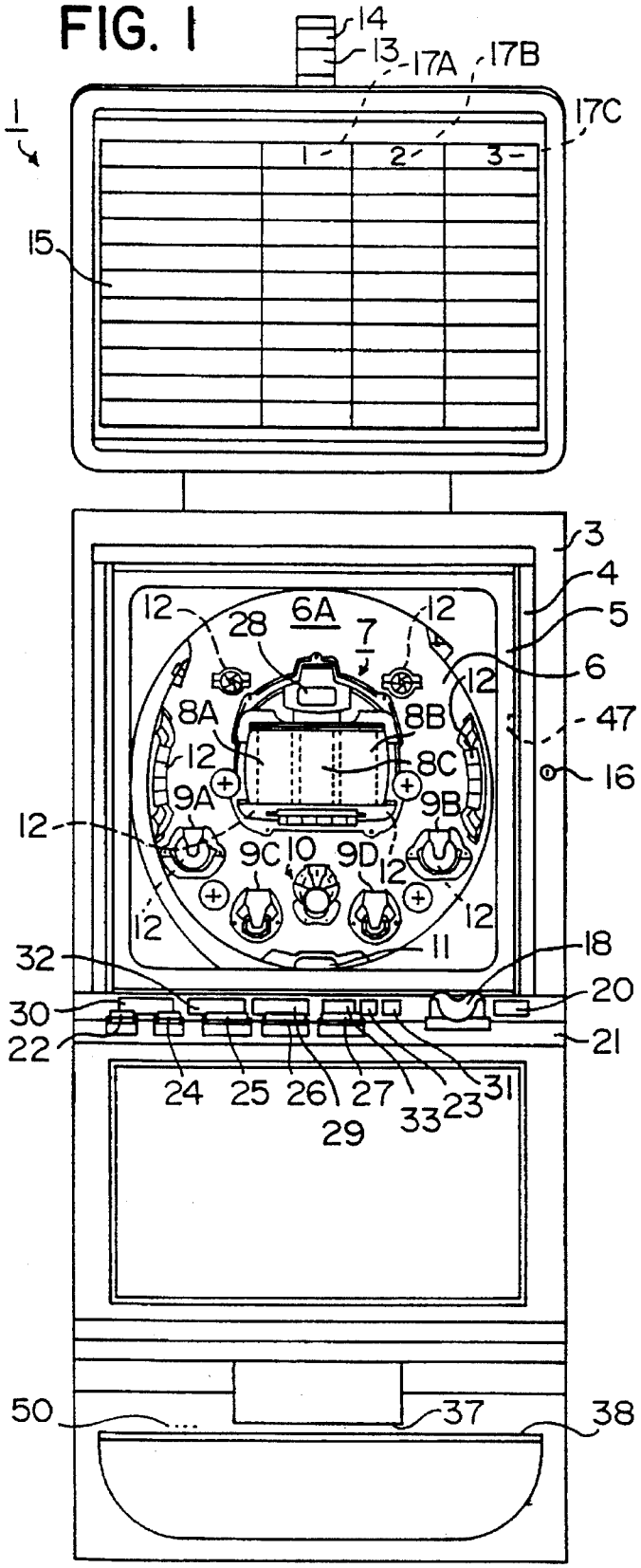
FIG. 1 is an overall front view of a flipped ball game machine.

FIG. 1 is an overall front view showing a flipped ball game machine as one example of a flipped ball game apparatus according to the present invention.

A front frame 3 that can be opened/closed are mounted on a main body 2 (see FIG. 2) of a flipped ball game machine 1. A door supporting frame 4 is attached to this front frame 3. A glass door frame (metal frame) 5 and a front cover plate 21 that can be opened/closed are mounted on door supporting frame 4. Glass door frame 5 serves to support a glass plate covering a front surface of a play field 6A formed on the front surface of a play board 6.

A key hole 16 is provided in front frame 3, through which a clerk in the game house inserts a key to conduct unlocking operation (e.g. to turn to the left of the figure) for unlocking and opening glass door frame 5. Opening of glass door frame 5 is detected by a metal frame open switch 47. If the key is turned to the right in the figure, then front frame 3 and front cover plate 21 are unlocked and opened. Opening of front frame 3 and front cover plate 21 is detected by a door open switch 46 (see FIG. 2).

On front cover plate 21 are provided a coin deposit slot 18 as one example of a valuable object receiving portion into which a player deposits a coin or coins as one example of valuable objects, and a coin deposit indicator LED 20. With a power supply of flipped ball game machine 1 turned on, coin deposit indicator LED 20 flashes to indicate, e.g., "INSERT COINS" and the like. On front cover plate 21 are also provided an exchange switch 22, a credit switch 24, a one-coin bet switch 25, a maximal coin number bet switch 26, and a start switch 27. Indicators are incorporated into respective switches. By pressing respective switches, lamps corresponding to the pressed switches are turned on or flash. More specifically, respective switches 22–27 are formed of so-called illumination type switches.

By pressing credit switch 24, a player can play a credit game. The credit game is such a game that in place of depositing necessary coins for each game, the player deposits a number of coins in advance, those coins being stored as a value and an acquired value being stored without being paid out, and the player draws coins necessary for one game from the stored value. This crediting function enables the player to play the game repetitively without depositing new coins for each game as far as the value is stored in the machine. The value stored during the credit game mode is displayed by a credit number display 30. If credit switch 24 is placed again, the player can play a usual coin-operated game. This coin-operated game is such a game that a required number of coins are deposited through coin deposit slot 18 for each game. In the credit game, the player can play a one-coin bet game by pressing one-coin bet switch 25. In this one-coin bet game, the number of coins for use in one game is limited to one. A single coin is thus required for a one-game play, so that a value to be given to the player in that one game will be of a low value corresponding to that single coin. If this one-coin bet switch 25 is pressed twice, the player can play a two-coin bet game. In this two-coin bet game, the number of coins for use in one-game is limited to two. Two coins are thus required for a one-game play, so that a value to be given to the player for that one game will be of a relatively large value corresponding to the two deposited coins. By pressing one-coin bet switch 25 three times or pressing maximal coin number bet switch 26, the player can play a maximal bet game. In this maximal bet game, the number of coins for use in one game is limited to, for example, three. Three coins are thus required for a one-game play, so that a value to be given to the player for that one game will be of a maximal value corresponding to the three deposited coins. The bet number input by operating one-coin bet switch 25 or maximal coin number bet switch 26 is indicated by a current bet number display 31. It is noted that a reference numeral 23 represents a last bet number display in which the bet number input before starting the last game is displayed. If the value stored during the credit game becomes large by, for example, occurrence of a big hit with a large dividend, the player operates exchange switch 22 after the game is over if the player wants to redeem the value in cash or a check instead of payout of coins. Then, the clerk exchanges the value into a check or the like.

A winning line display panel 15 is provided above main body 2 of the flipped ball game machine. Winning line display panel 15 indicates the values to be paid corresponding to respective bet numbers when a hit occurs. The numerals 1, 2, and 3 indicated in the upper part of the display screen of winning line display panel 15 respectively indicate the input bet number, and a one-coin bet lamp 17A, a two-coin bet lamp 17B, and a three-coin bet lamp 17C are respectively contained for each numeral. The lamp corresponding to the input bet number is turned on to indicate the current bet number. Kinds of winning display results of a variable display apparatus 7 are shown in respective rows located on the left of winning line display panel 15, and the number of coins to be paid out or the like corresponding to the kind of winning is indicated for the cases of one-coin bet, two-coin bet, and three-coin bet. One-coin bet lamp 17A, two-coin bet lamp 17B and three-coin bet lamp 17C form a bet number displaying means.

With the bet number being input in response to the player's coin depositing through coin deposit slot 18 or operating one-coin bet switch 25 or maximal coin number bet switch 26 in the credit game, if the player presses start switch 27, balls corresponding to the bet number are automatically flipped into play field 6A, which will be described later. On the other hand, play field 6A is provided with a variable display apparatus 7 including a plurality (three in the figure) of variable display portions 8A, 8B, and 8C which changeably display a plural kinds of symbols or the like as one example of identification information so as to change a display state. This variable display apparatus 7 starts changing in response to pressing of start switch 27 or maximal coin number bet switch 26 in the credit game. When all balls allotted to a specific game are flipped into play field 6A, the left variable display portion 8A stops first, then the left variable display portion 8B stops, and then the middle portion 8C stops. At this time, if the display results in a specific combination (e.g., 777), coins are paid out from a coin payout outlet 37 into a coin receiving tray 38 as prizes in accordance with dividends displayed on winning line displaying panel 15. The number of coins to be paid out is indicated by a payout number display 29. It is noted that in the case of the credit game, the number of coins to be paid out indicated in an acquired coin number display 32 is added to the credit number indicated in credit number display 30 instead of being paid out, and the addition result is indicated in credit number display 30.

In the meanwhile, in play field 6A are provided a plurality of winning holes 9A–9D and a variable winning ball apparatus (a tulip-shaped winning hole) 10 capable of being changed into a first state which is advantageous to the player and a second state which is disadvantageous to the player. The number of winning PACHINKO balls which have entered these winning holes or the variable winning ball apparatus in one game is indicated by a wining ball number display 33. Thus, coins corresponding to the number of winning balls are paid out to coin payout outlet 37 or, in the case of the credit game, the number of coins is added to the number in credit number display 30. A remaining ball number display is designated by 28 which serves to indicate the number of remaining balls calculated by subtracting the number of balls flipped into play field 6A from the number of balls allotted to one game. 12 designates a board lamp which is turned on or flashes in response to the game state.

Above winning line display panel 15 are provided an error lamp 14 and a jackpot lamp 13. Error lamp 14 is turned on or flashes when an error described below occurs or exchange switch 22 described above is operated, while jackpot lamp 13 is turned on or flashes when a big hit occurs wherein the specific combination of symbols (e.g., 777) is displayed by variable display apparatus 7. 50 designates a speaker which generates a sound effect when a hit occurs or the like. In variable display apparatus 7, the total of five winning lines are determined by three lateral lines in the upper, middle, and lower rows and two diagonal lines, such that a big hit occurs if the specific combination of symbols is given on one of these five lines.

Figure 2:
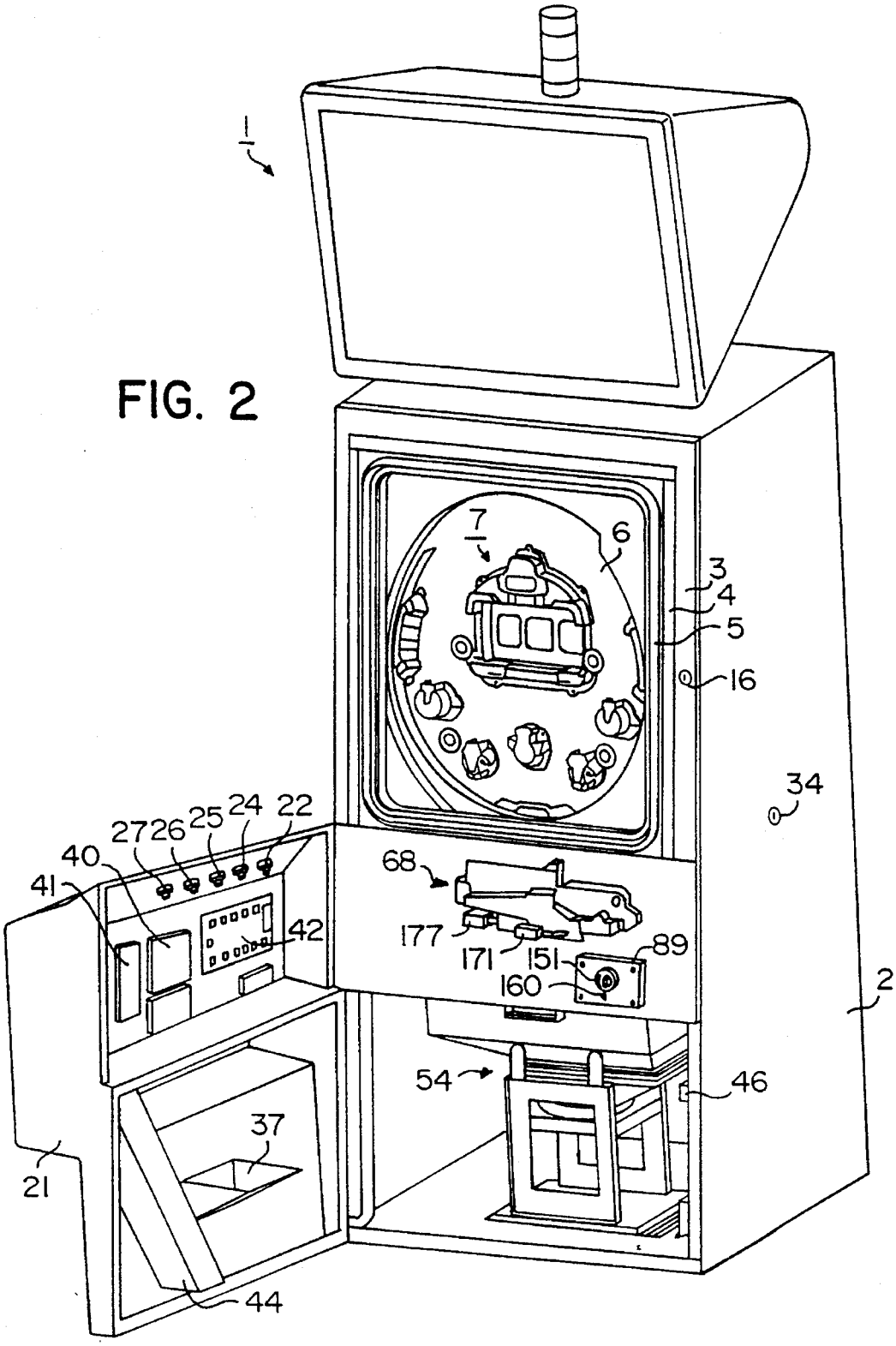
FIG. 2 is a perspective view showing a part of an internal structure of the flipped ball game machine.

FIG. 2 is an overall perspective view showing a part of an internal structure of a part of the flipped ball game machine. Front cover plate 21 capable of being opened/closed and provided on front frame 3 of game machine 1 is opened to expose a coin selector 40 as one example of a valuable object reception defecting means, and a coin distributor 41. Coin selector 40 serves to determine whether or not proper coins are deposited from coin deposit slot 18 and, if improper coins are deposited, return those coins from coin payout outlet 37. Also, coin selector 40 serves to detect proper coins being deposited and transmit a detect signal to a main board 120 (see FIG. 3). If a second sensor of coin selector 40 located downstream of a coin passage does not produce the detect signal within, for example, 200 msec after a first sensor located upstream of coin passage has produced the detect signal, an error occurs. On the other hand, coin distributor 41 is provided to determine whether the deposited coins are distributed into a hopper 54 or discharged out of the machine through a collecting gutter 44 and collecting inlet 45 (see FIG. 3), such that coin distributor 41 operates to distribute the deposited coins toward collecting gutter 44 side in response to a signal from an overflow switch 56 described below for detecting an overflow of hopper 54. Reference 42 designates a relay board for relaying respective switches, lamps, the coin selector and the like provided on front cover plate 21 to a sub-board 121 (see FIG. 3) described below.

A ball waiting mechanism 68 is provided at the lower part of play board 6, whereby the balls waiting in ball waiting mechanism 68 are sequentially fed to a shooting position to be flipped into the front side of play board 6. Reference numerals 171 and 177 designate a ball ejecting solenoid and a ball ejection resetting solenoid, respectively. A reference numeral 89 designates a flipping force fine controller which allows fine control of the flipping force by manipulating an adjustment pick-up 151 with an operating pick-up 160 being operated. A reference numeral 46 designates the door open switch for detecting opening of front cover plate 21.

A key switch 34 is provided on the side of main body 2 of flipped ball game machine 1. The clerk in the game house can insert a given key into key switch 34 to switch from a data display mode to a reset mode. By pressing one-coin bet switch 25 with key switch 34 being operated to switch into the data display mode, displays formed by a 7 segment LED, i.e., credit number display 30 as one example of a game result value output means, acquired coin number display 32, payout coin number display 29, and winning ball number display 33 as one example of a winning ball number output means, together with variable display apparatus 7 when stopped, display the state of the previous game, so that various game conditions of the previous game can be recognized. Further, by pressing maximal coin bet number switch 26 instead of one-coin bet switch 25, various game conditions of a game which is two games prior to the current game are similarly displayed to allow recognition of various game conditions of that game. Payout number display 29 or acquired coin number display 32 forms the game result value output means. Key switch 34, one-coin bet switch 25, payout number display 29, winning ball number display 33, credit number display 30 and acquired coin number display 32 form a game result output means. Deposit of coins from coin deposit slot 18 is inhibited during display of such various game conditions of the game. Then, when key switch 34 is operated to be returned to the original position, the state allowing the usual play is returned. On the other hand, if key switch 34 is operated to switch into the data display mode with coin deposit being waited, all the above-described 7 segment LED displays will display "-". At this time, various data are displayed by means of credit number display 30, acquired coin number display 32 and winning ball number display 33 upon pressing of start switch 27. More specifically, the kind of data to be displayed is indicated by winning ball number display 33, and the actual data corresponding thereto are displayed by credit number display 30 and acquired coin number display 32. Specific examples of the displayed data include: the profit of the machine; the total number of winning balls fell into winning holes or the variable winning ball apparatus; the payout ratio; the number of games performed after front cover plate 21 is closed; the number of games performed after turning on of the power supply; the number of one-coin bet games performed; the number of two-coin bet games performed; the number of three-coin bet games performed; the number of opening of front cover plate 21 and front frame 3; and the number of opening of glass door frame 5.

In the figure, reference numerals 22, 24, 25, 26, 27, 7, 4, 5, and 16 respectively designate the exchange switch, the credit switch, the one-coin bet switch, the maximal coin number bet switch, the start switch, the variable display apparatus, the door supporting frame, the glass door frame, and the key hole. In addition, 37 designates the coin payout outlet into which the payout coins from coin hopper 54 are distributed for payout into coin receiving tray 38.

Figure 3:
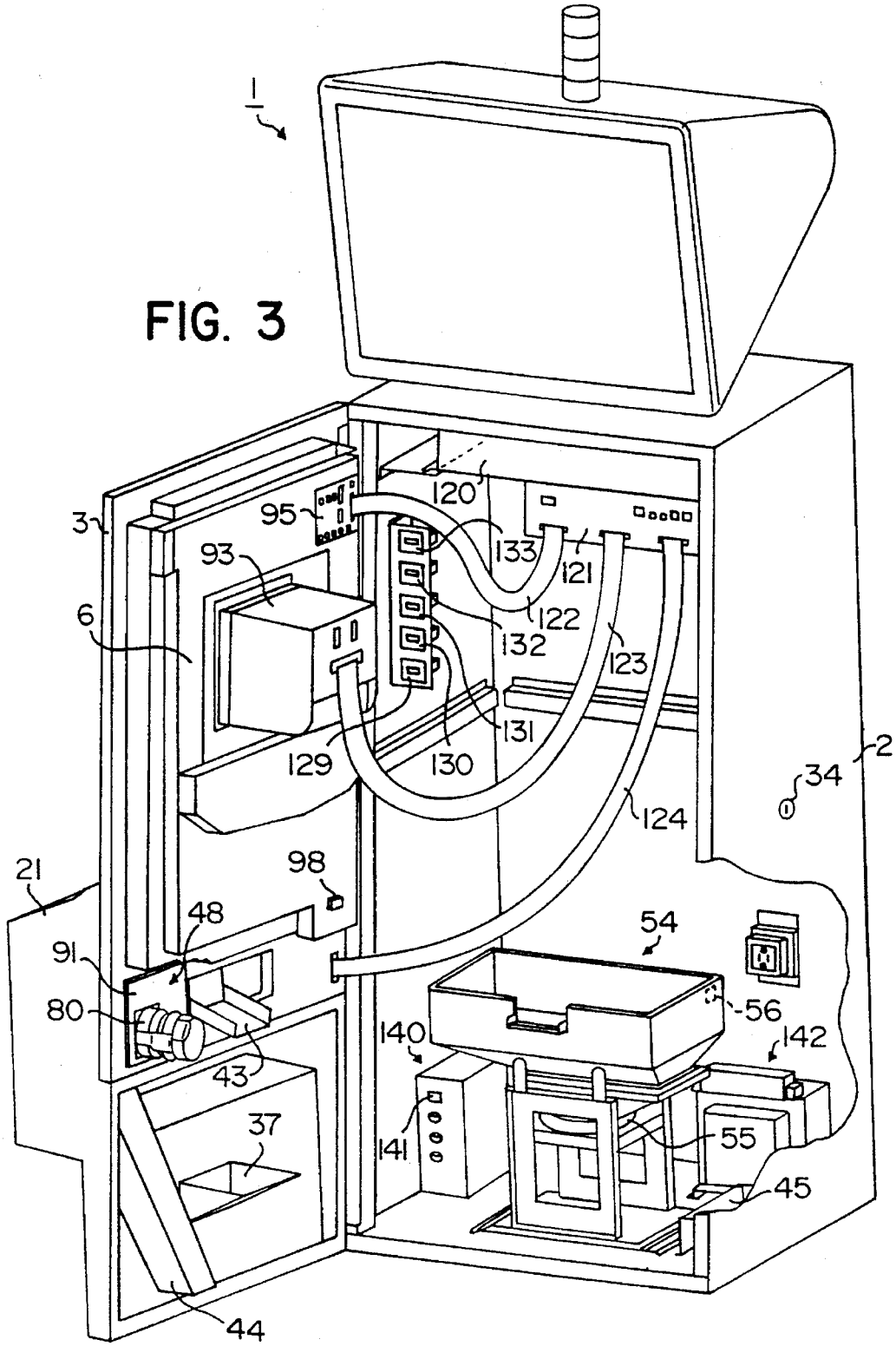
FIG. 3 is a perspective view showing an internal structure of the flipped ball game machine.

FIG. 3 is a perspective view for use in explaining an internal structure of the game machine.

At the lower part of front frame 3 is provided a communication passage 43 for communicating coins deposited from coin deposit slot 18 to coin hopper 54, such that the coins distributed by coin distributor 41 and collected in the machine are deposited into coin hopper 54 through this communication passage 43. Also provided at the lower part of front frame 3 is a ball shooting mechanism 48 as one example of a ball shooting means mounted by a mounting board 91. Ball shooting mechanism 48 operates by rotating force of a shooting motor 80 to flip PACHINKO balls into play field 6A one after another.

An opening is provided almost at the center of play board 6 for providing by insertion a drum box 93 of variable display apparatus 7. Drum box 93 is provided in the opening such that respective variable display portions 8A, 8B, and 8C provided on the front side of drum box 93 are looking out on play field 6A. Also, a relay board 95 is provided at the upper part of play field 6.

At the upper part of main body 2 of the game machine is provided main board 120 for controlling the overall game machine, together with sub-board 121 for relaying a signal to main board 120. This sub-board 121 is respectively connected to relay board 95, drum box 93, and relay board 42 of front cover plate 21 (see FIG. 2) by flat cables 122, 123, and 124, respectively.

At the lower part of main body 2 of the game machine is provided coin hopper 54 in which overflow switch 56 is provided. When coin hopper 54 is full of coins, overflow switch 56 detects this state and inputs a detect signal to main board 120. Below coin hopper 54 is provided a coin hopper motor 55 which is rotated to pay out a predetermined number of coins into coin payout outlet 37. Also, main body 2 of the game machine is provided with a fuse box 140 in which a power supply switch 141 is operated to turn on/off the power supply. The fuse contained in fuse box 140 is blown to shut off the power supply upon input of an unusual high voltage. 142 in the figure designates a transformer.

A reference numeral 98 designates a ball eject switch as one example of a ball discharge operating means which is operated to excite ball ejecting solenoid 171 in ball waiting mechanism 68 for extracting balls within the mechanism out of the machine, which will be described later.

Additionally, on main body 2 side of the game machine are provided a counter for counting total deposited coins 129 (hereinafter referred merely to as counter 129), a counter for counting total paid-out coins (hereinafter referred merely to as counter 130), a counter for counting total winning balls 131 (hereinafter referred merely to as counter 131), a counter for counting total overflown coins 132 (hereinafter referred merely to as counter 132), and a counter for counting total handed-in coins 133 (hereinafter referred merely to as counter 133). Counter 129 counts and displays the total number of coins deposited from coin deposit slop 18. Counter 130 counts and displays the total number of coins paid out from coin payout outlet 37. Counter 132 counts and displays the number of coins which are overflown from coin hopper 54 being full of coins and incapable of storing any more coins, and discharged out of the machine from collecting inlet 45. In the case when exchange switch 22 described above is operated so that the given value is directly handed to the player in the form of the check or the like instead of coins being paid out, the magnitude of the value handed directly to the player is converted into the number of coins which is counted and displayed by counter 133. More specifically, the clerk operates to reset key switch 34 after submitting the check or the like to the player, whereby the stored value (the value of the credit counter described below) is counted and displayed by counter 133, and then the credit number is cleared. Counter 130 counts the paid-out coins at such times as payout of coins from coin hopper 54 in accordance with the display result of variable display apparatus 7 and winning of balls, payout of coins from coin hopper 54 corresponding to the value stored in the credit game, and draw-away of that stored value for use in the game. Counter 129 counts the deposited coins at such times as draw-away of the stored value for use in the credit game, and deposit of one coin from coin selector 40. Note that 44 in the figure designates the collecting gutter.

Figure 4:
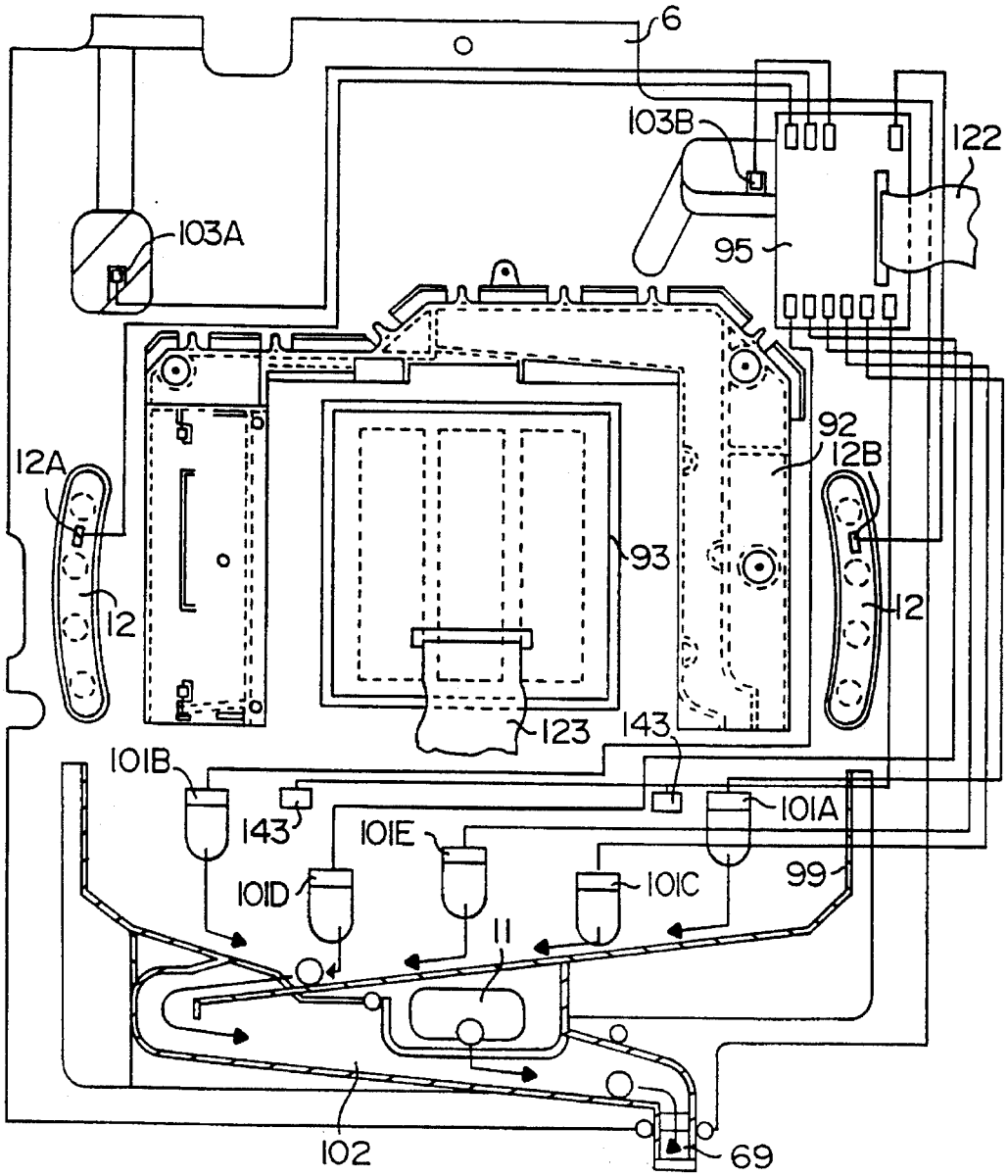
FIG. 4 is a rear view for use in explaining various apparatuses provided on the rear side of a play board.

FIG. 4 is a rear view for use in explaining various apparatuses provided on the rear side of play board 6. Drum box 93 is provided protruding backward from play board 6, and a winning ball cover 92 is mounted on the rear side of play board 6 so as to surround drum box 93. Winning hole sensors 101A–101E formed by proximity switches are provided in respective winning holes and the variable winning ball apparatus. Those winning balls entered in respective winning holes and the variable winning ball apparatus are collected in a winning ball collecting gutter 99 and those winning balls are merged with lost balls fed into a lost ball port 11 in a merging gutter 102, so as to be returned into ball waiting mechanism 68 from a ball outlet 69. Upon detection of winning balls by winning hole sensors 101A–101E provided in respective wining holes and the variable winning ball apparatus, lamps provided in the detected winning holes or the variable winning ball apparatus are controlled to be turned on or to flash. It is noted that these winning hole sensors 101A–101E determine an error when the detection output thereof is generated continuously for two seconds, thus allowing detection of disconnection or short circuit of the winning hole sensors. Also, a magnetic sensor 143 is provided in proximity to winning hole sensors 101A–101E, such that if the player plays unfair by bringing a magnet or the like close to the winning hole, magnetic sensor 143 senses its magnetic force to detect an abnormal condition. These winning hole sensors 101A–101E and magnetic sensor 143 are electrically connected to sub-board 121 through relay board 95 and flat cable 122 by means of interconnections. Also, board lamp 12 and relay board 95 are electrically connected by connectors 12A and 12B. Note that 123 in the figure designates flat cable, and 103A and 103B designate connectors.

Figure 5:
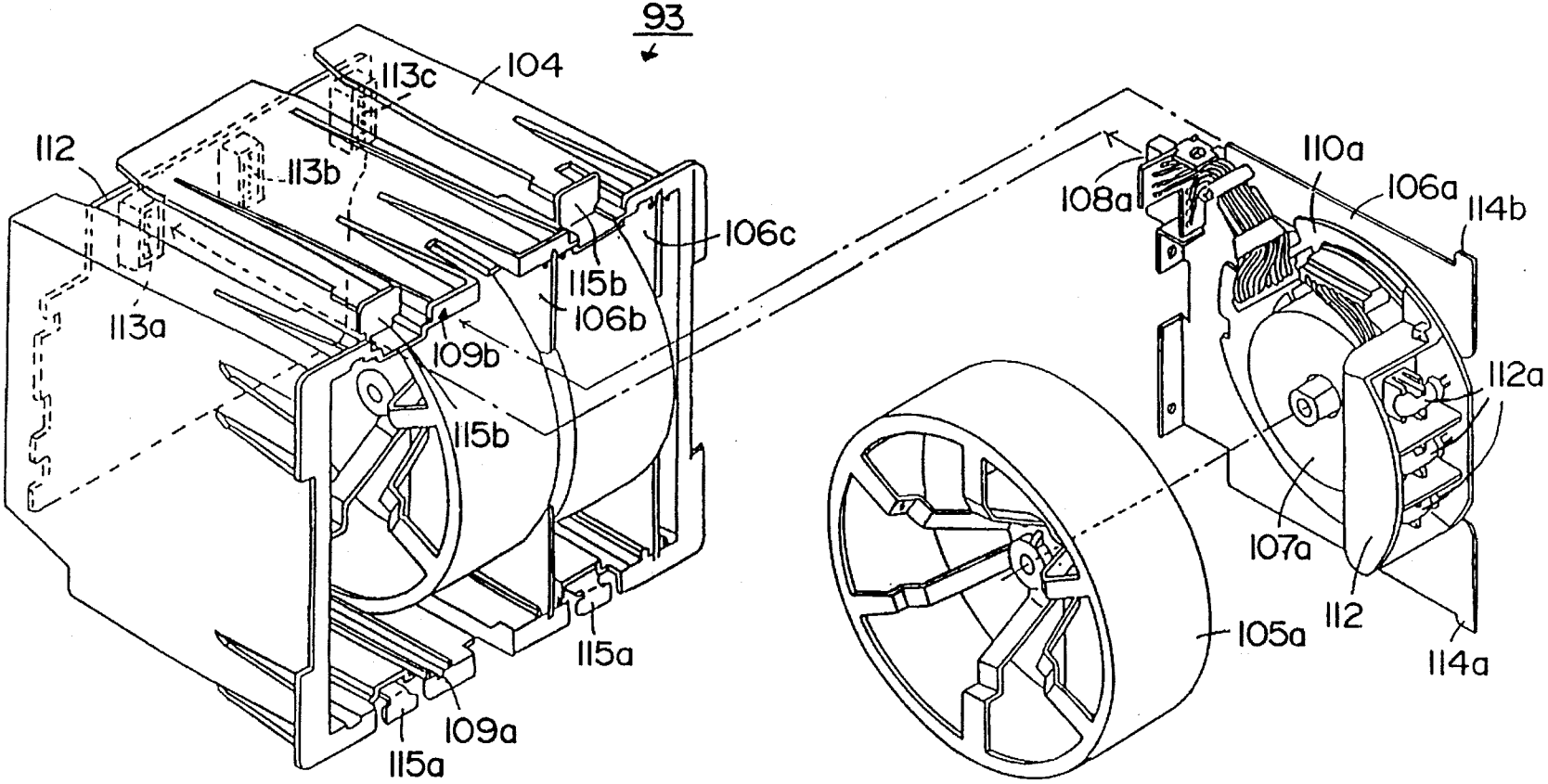
FIG. 5 is an exploded perspective view for use in explaining a structure of a drum box.

FIG. 5 is an exploded perspective view for use in explaining a structure of a drum box. Drum box 93 is consisting of a plurality (three in the figure) of drums (reels) 105*a*, 105*b*, and 105*c* as examples of variable display members inserted into drum storage box 104. Each of drum 105*a* have the plural kinds of symbols provided on an outer periphery thereof. Each drum 105*a* is provided on a rotary axis of a drum motor 107*a* mounted to mounting board 106*a* as one example of a mounting member. At the upper and lower ends of mounting board 106*a* are formed fitting projections 114*a* and 114*b*, such that mounting board 106*a* is inserted into fitting trenches 109*a* and 109*b* formed in storage box 104, positioned with projections 114*a* and 114*b* being fitted in trenches 109*a* and 109*b*, and fixed by a screw or the like. By inserting such a mounting board 106*a* into storage box 104, connector 108*a* as one example of an electrical connecting means formed in mounting board 106*a* is fitted into connector 113*a* as one example of an electrical connecting means of a relay board 112 provided on storage box 104 side to allow electrical connection therebetween. Relay board 112 is electrically connected to sub-board 121 by flat cable 123, as described above. Mounting board 106*a* has a printed circuit board 110*a* connected thereto, which is electrically connected to connector 108*a*, thereby supplying a current into drum motor 107 and drum lamp 112*a* through printed circuit board 110*a*. Drum lamp 112*a* is provided within a drum house 112.

On the opened side of storage box 104 are formed mounting lugs 115*a* and 115*b* for mounting drum box 93 on the rear side of play board 6. Drum box 93 is screwed into the rear side of play field 6 by abutting mounting lug 115*b* against the rear side of the play board with mounting lug 115*a* being fitted into a mounting concave portion formed on the play board. Thus, the position of opening 106*c* formed in drum box 93 matches the position of the opening formed in the play board, and respective drums 105*a*, 105*b*, 105*c* are rotated thereby to display changeably symbols provided on the outer periphery of the drum at respective variable display portions 8*a*, 8*b*, and 8*c*. It is noted that variable display apparatus 7 is not limited to of the rotating drum type and may be implemented by an electrical display apparatus such as liquid crystal, LED (Light Emitting Diode), electroluminescence, CRT (Cathode-Ray Tube), fluorescent display tube and the like.

Figure 6:
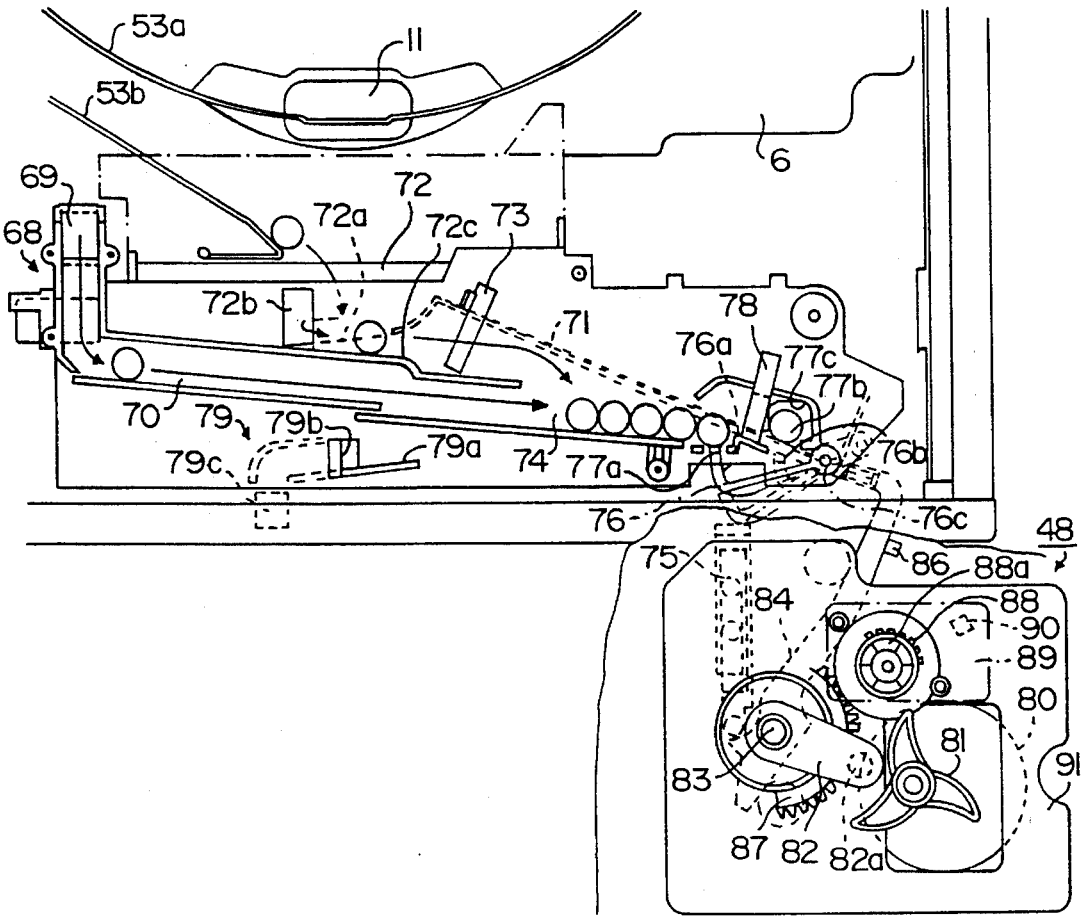
FIG. 6 is a structural view showing structures of a ball waiting mechanism and a ball shooting mechanism.

FIG. 6 shows structures of ball waiting mechanism 68 and ball shooting mechanism 48. In ball waiting mechanism 68 is provided a stored ball passage 70 for keeping stored balls waited, whereby PACHINKO balls exiting from ball outlet 69 described above are stored in the waiting condition on stored ball passage 70. At this time, a star wheel 81 is rotated upon rotation of shooting motor 80. A roller 82*a* is provided on the free end side of a pivoting member 82 which turns about a rotating axis 83 integrally with a flipping hammer 84. Flipping hammer 84 is spring-loaded (not shown) in the direction of shooting balls, whereby star wheel 81 is driven by rotation so as to press roller 82*a* downward thereby to swing flipping hammer 84 backward against an urging force of the spring. Then, with abutment of star wheel 81 against roller 82*a* being released, flipping hammer 84 turns in the ball shooting direction by means of the restoring force of the spring. In accordance with the reciprocating pivoting of flipping hammer 84, a ganged ascending/descending part 75 moves upward and downward, thus swinging a ball feeding member 76 up and down about an axis 76*c* as a pivot. Holes 77*a* and 77*b* are provided in two places at the end portion in the downstream of PACHINKO balls kept in the waiting state, those PACHINKO balls being partly fitted into hole 77*a*. In this state, by swinging ball feeding member 76, ball push-up members 76*a* and 76*b* formed at the tip of ball feeding member 76 pass through both holes 77*a* and 77*b* from the bottom to the top for pushing up a PACHINKO ball upward to the right. Then, the PACHINKO ball pushed up by ball push-up member 76*a* moves to the right and stops fitted partly in hole 77*b*. Upon next swing of ball feeding member 76, the PACHINKO ball partly fitted in hole 77*b* is pushed up by ball push-up member 76*b* so as to be fed to the ball shooting position from a ball feeding hole 77*c*. The PACHINKO ball set in the shooting position is flipped by swinging flipping hammer 84 along a ball shooting rail 71 into play field 6A through between an inner rail 53*a* and an outer rail 53*b*. In the figure, 78 designates a ball feed sensor as one example of a ball shooting detecting means for detecting a PACHINKO ball moving from hole 77*a* to hole 77*b*.

A foul ball, which fails to reach play field 6A because the flipping force was too weak to flip the PACHINKO ball into play field 6A, falls into a foul ball port 72 so as to be discharged from a foul ball outlet 72*b* through a foul ball passage 72*a*. The foul ball is then returned into stored ball passage 70, which is detected by a foul ball sensor 73.

The mounting board for mounting ball shooting mechanism 48 is designated by 91 in which flipping force fine controller 89 is provided. Flipping force fine controller 89 serves to finely control tension of the spring which urges flipping hammer 89 in the direction of shooting balls, wherein adjustment pick-up 151 is rotatably adjusted to rotate a member 88*a* fitted in a coupling hole 153 (see FIG. 10), thus rotating a semicircular toothed gear 87, whereby tension of the spring urging flipping hammer 84 in the ball shooting direction can be finely controlled allowing fine control of the flipping force. A light shielding member 86 is provided in flipping hammer 84, wherein light shielding member 86 intercepts the light projected from a flipping hammer sensor 90 of a light project/receive type due to a clockwise swing of flipping hammer 84, thus allowing flipping hammer sensor 90 to detect the PACHINKO ball being flipped by the swing of flipping hammer 84.

A pivoting gutter 74 which turns about a pivot shown in the right hand side of the figure is provided in the lower portion in the downstream of the ball flow in stored ball passage 70, wherein ball eject switch 98 (see FIG. 3) is operated to allow pivoting of gutter 74 downward so as to drop the balls stored in passage 70 toward a ball ejecting passage 79. More specifically, since a ball inlet 79*b* is provided in ball ejecting passage 79, pivoting gutter 74 downward enables the stored PACHINKO balls to enter ball inlet 79*b* to flow on ball ejecting gutter 79*a* so as to be discharged out of the machine from a ball outlet 79*c*. The PACHINKO balls discharged out of the machine are automatically polished to be returned into stored ball passage 70. In the figure, 11 designates a lost ball port and 6 designates the play field.

Figure 7:
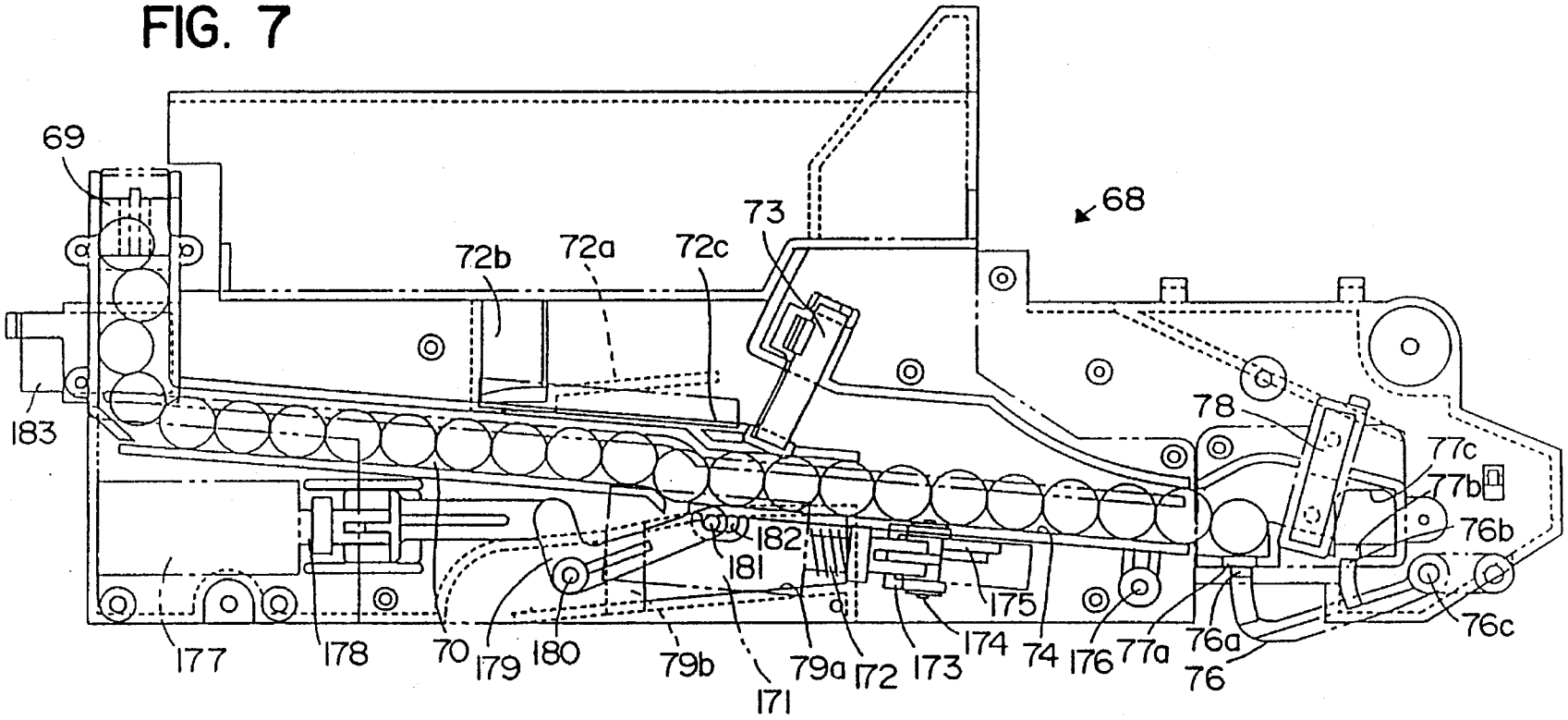
FIG. 7 is a structural view showing the ball waiting mechanism.
Figure 8:
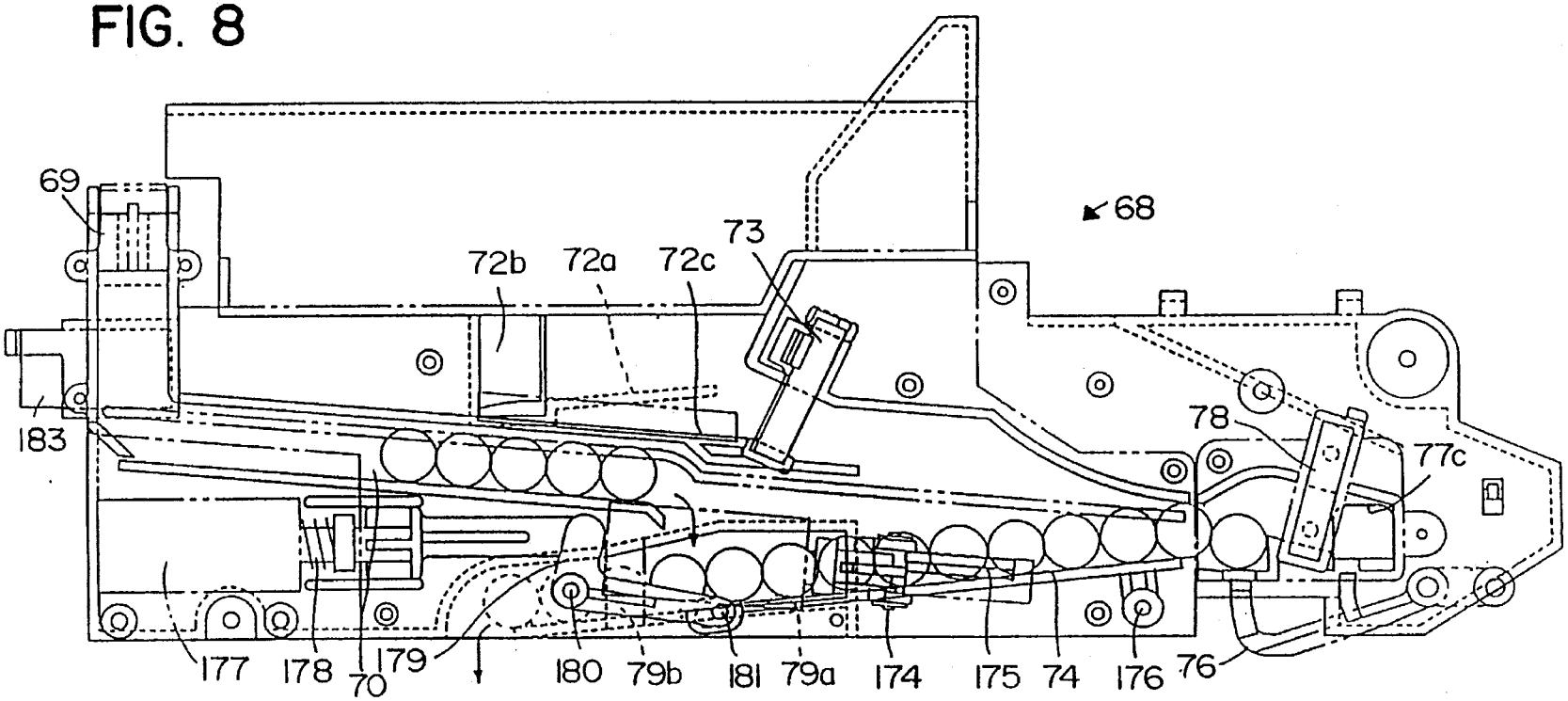
FIG. 8 is a structural view showing the ball waiting mechanism.

FIG. 7 shows a structure of ball waiting mechanism 68 in the ball waiting state. FIG. 8 shows a structure of ball waiting mechanism 68 in the ball ejecting state. At the lower part of stored ball passage 70 are provided ball ejecting solenoid 171 and ball ejection resetting solenoid 177. A pivoting member 173 which moves pivotably about a pivotal axis 174 extending longitudinally is coupled to a plunger 172 of ball ejecting solenoid 171. When plunger 172 is extended with ball ejecting solenoid 171 being not excited, a supporting member 175 of pivoting member 173 is inserted below pivoting gutter 74 for support, thus preventing gutter 74 from pivoting downward.

On the other hand, when ball ejecting solenoid 171 is excited to suck up plunger 172, pivoting member 173 pivots to rotate supporting member 175 in the clockwise direction when viewed from above ball waiting mechanism 68. Then, pivoting gutter 74 swings downward about rotating axis 176 since supporting member 175 is removed. The stored PACHINKO balls thus flow down along pivoting gutter 74 to enter ball ejecting gutter 79*a* through ball inlet 79*b*, and then flow through ball outlet 79*c* to be discharged out of the machine. On the other hand, if pivoting gutter 74 which is not supported from below due to pivoting of supporting member 175 pivots downward, then as shown in FIG. 8, one side of pivoting gutter 74 is abutted to the other side of supporting member 175. The abutment is maintained so that pivoting gutter 74 prevents supporting member 175 from being restored to the original position, even if excitation of ball ejecting solenoid 171 is released.

Next, when ball ejection resetting solenoid 177 is excited, plunger 178 is sucked to cause a link member 179 to turn in the counterclockwise direction about a pivotal axis 180. At the end of link member 179 is provided a pin 181 which fits with an elongate hole 182 formed on the free end side of pivoting gutter 74, whereby pivoting link member 179 in the counterclockwise direction enables pivoting gutter 74 to be lifted upward via pin 181, thus releasing the abutment of one end of pivoting gutter 74 against the other end of supporting member 175 so as to restore supporting member 175 to the original position. Thus, gutter 74 is held in the lift-up position by supporting member 175, thus enabling the PACHINKO balls to be stored. Reference 183 designates a ball number detector for detecting lowering of the stored ball amount below a predetermined level to turn on a shortage display lamp or the like. Ball ejecting solenoid 171, ball ejection resetting solenoid 177, link member 179 and supporting member 175 form a ball discharge operating means. It is noted that the same reference numerals given to respective portions of ball waiting mechanism 68 in FIGS. 7 and 8 indicate the same parts in FIG. 6, and the description thereof will not be repeated.

Figure 9:
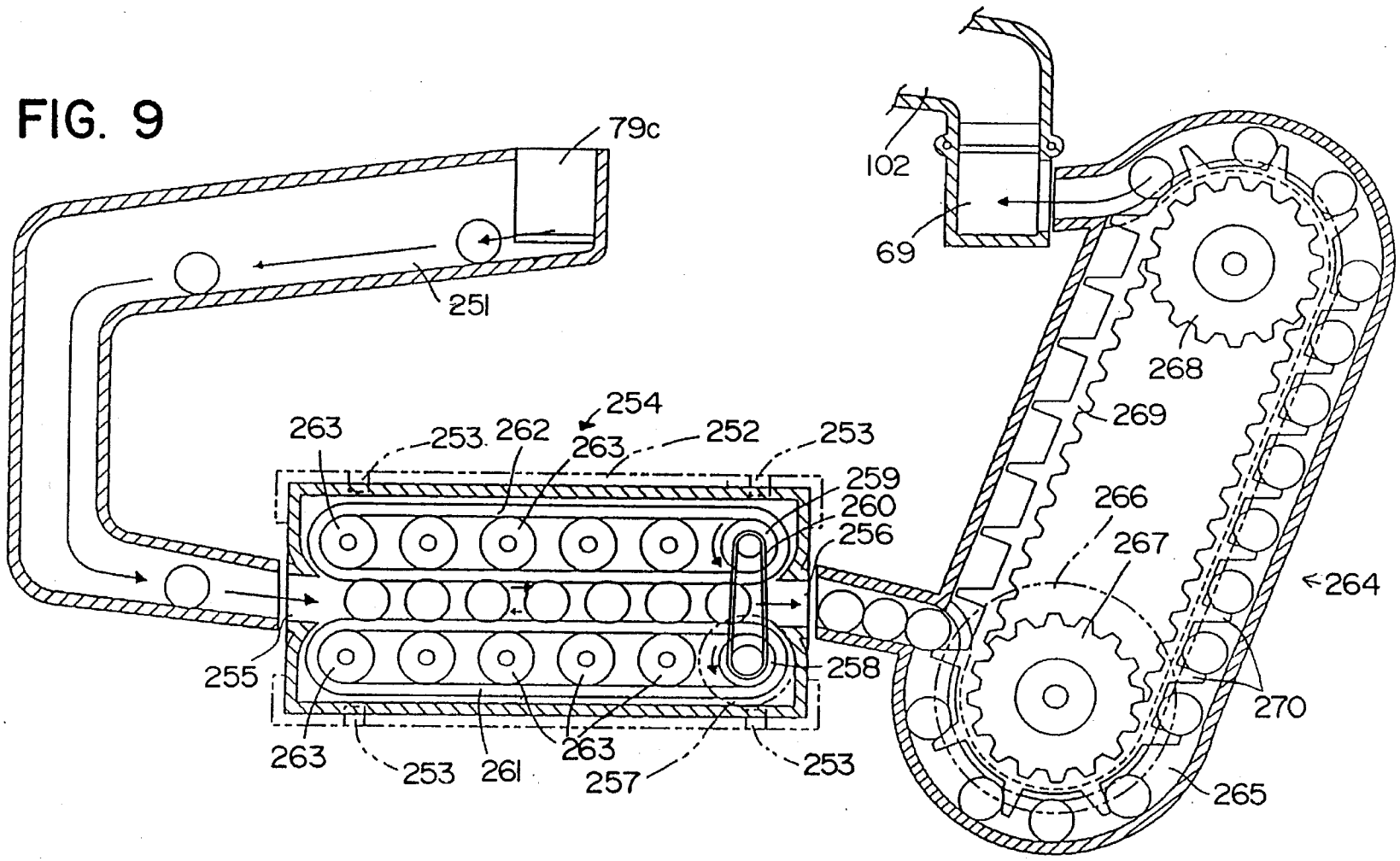
FIG. 9 is an action view for use in explaining an operation of a ball polishing and restoring apparatus.

Another embodiment is shown in FIG. 9 wherein a structure of a polished ball restorer 264 for polishing the stored ball in the machine without discharging the balls out of the machine and for restoring those balls into ball waiting mechanism 68.

This polished ball restorer consists of a ball polisher 254 as one example of a contamination removing means and a ball lifter/restorer 264. The PACHINKO balls exiting from ball outlet 79*c* of ball ejecting passage 79 (see FIG. 6) are introduced into a ball inlet 255 of ball polisher 254 through a guiding gutter 251. This ball polisher 254 is mounted by insertion into a mounting frame 252 like a cassette, the polisher when its ball polishing capability is decreased after usage for a predetermined period capable of being removed for replacement with a new polisher. A plurality of nails 253 are formed in mounting frame 252 for engagingly holding the inserted ball polisher 254.

Ball polisher 254 is provided with a motor 257 by which a roller 258 is rotated. As shown in the figure, roller 258 is provided with a large diameter pulley of which rotating force is transmitted through a belt 260 to a roller 259 in which a small diameter pulley is provided. As a result, roller 259 rotates faster than roller 258. A plurality of rollers 263 which are rotatably supported around an axis (hereinafter referred merely to as rollers 263) are provided, and a ball polishing belt 261 as one example of a ball polishing member is wound over roller 258 and the plurality of rollers 263. Also, a ball polishing belt 262 as one example of a ball polishing member is wound over roller 259 and the plurality of rollers 263. Therefore, roller 259 rotates faster than roller 258, so that the PACHINKO balls entered from ball inlet 255 are conveyed slowly to the right with being rotated in the clockwise direction, during which the surfaces of balls are polished. Then, the balls are transported from a ball outlet 256 to ball lifter/restorer 264 side.

Ball lifter and restorer 264 is provided with a gear 267 which is driven by rotation by a motor 266, wherein a ball lifting belt 269 is wound over gear 267 and a gear 268 which is rotatably supported around an axis (hereinafter referred merely to as gear 268). Rotating gear 267 by motor 266 enables introduced PACHINKO balls to be lifted by a ball mounting portion 270 of ball lifting belt 269 and discharged to ball outlet 69. Merging gutter 102, stored ball passage 70, and the pivoting gutted 74; or merging gutter 102 and guiding gutter 251 form a circulation passage. Reference 102 in the figure designates the merging gutter for merging winning balls with lost balls to guide them to ball outlet 69. Winning ball collecting gutter 99, merging gutter 102, and ball waiting mechanism 68; or winning ball collecting gutter 99, merging gutter 102, guiding gutter 251, ball polisher 254, and ball lifter and restorer 264 form a ball circulation and restoring means.

Figure 10:
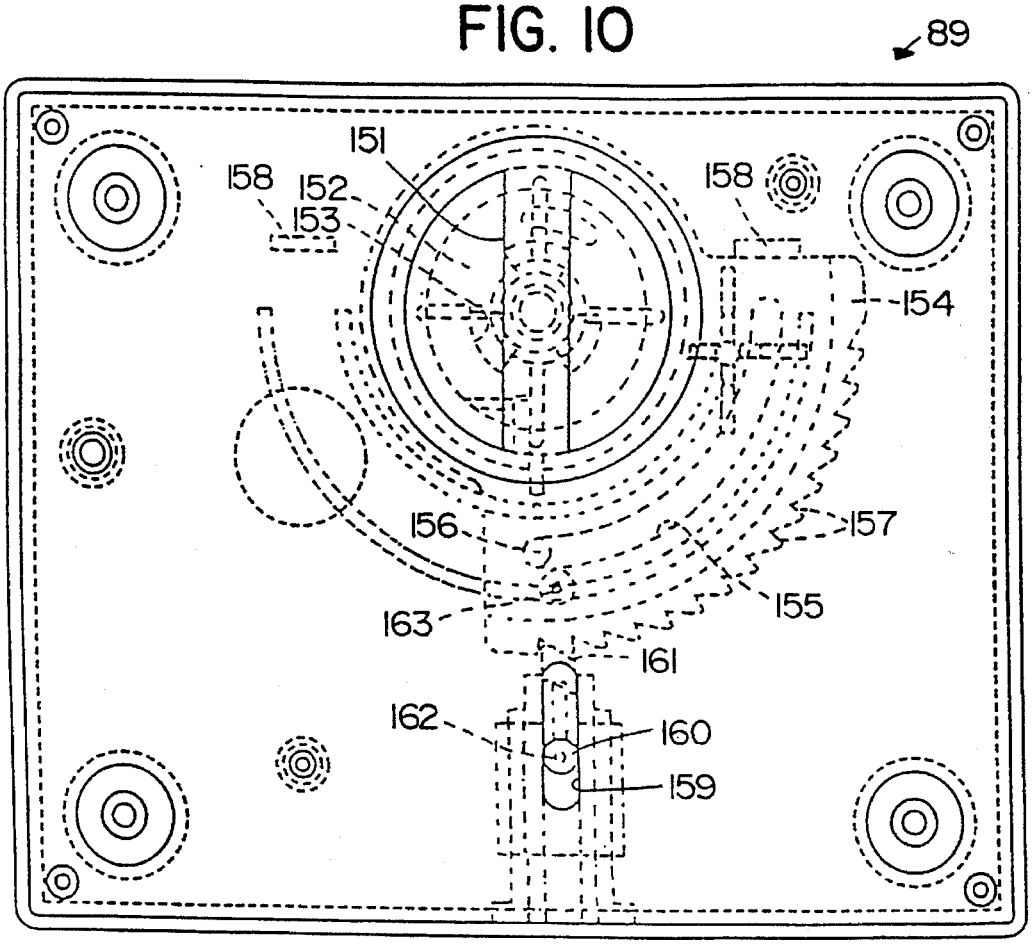
FIG. 10 is a structural view showing a structure of a shooting force fine controller.

FIG. 10 shows a structure of the flipping force fine controller as one example of a second shooting force variably setting means. Flipping force fine controller 89 is provided with adjustment pick-up 151 which is rotated integrally with a disc 152 and a gear 154.

Below gear 154 is provided operating pick-up 160 with which an engagement projection 161 slides upward and downward integrally. A pin 162 protrudes from behind operating pick-up 160, and a tensile spring (not shown) extends over pin 162 and a fixed pin 163. Engagement projection 161 is tensed upward in the figure by the restoring force of the tensile spring so as to be in engagement with a serrated teeth 157 of gear 154.

In disc 152 is provided a communicating hole 153 in which a projection of rotating member 88*a* (see FIG. 6) is fitted. At this time, if the clerk in the game house pushes down operating pick-up 160 against the tensile spring, then the engagement of engagement projection 161 with serrated teeth 157 is released. Upon rotation of adjustment pick-up 151, semicircular gear 87 (see FIG. 6) is rotated via disc 152 and rotating member 88*a* thereby adjusting the tensile strength of the spring extending in the direction of shooting balls. Thus, the urging force of flipping hammer 84 in the ball shooting direction can be adjusted thus allowing the control of flipping force thereof. Reference 158 in the figure designates a stopper which is in abutment against gear 154 for regulating a rotating angle of adjustment pick-up 151. Operating pick-up 160 can be rotated without being pressed down when adjustment pick-up 151 is rotated in the clockwise direction (i.e., in the direction for strengthening the flipping force). Adjustment pick-up 151 and operating pick-up 160 form an adjustment portion. Engagement projection 161 and serrated teeth 157 form a starting condition determining means.

Figure 11A:
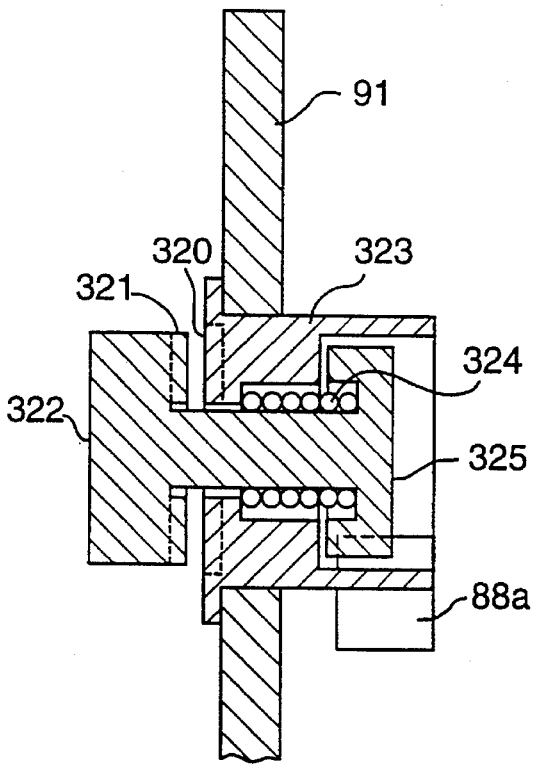
FIGS. 11A and 11B are action views for use in explaining an operation of a shooting force adjustment mechanism.
Figure 11B:
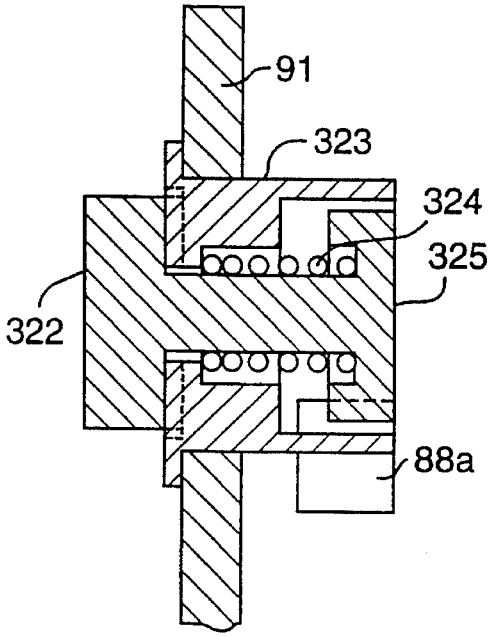

FIGS. 11A and 11B are action views for use in explaining an adjustment method of a flipping force by a flipping force adjustment portion as one example of a first shooting force variable setting means provided separately from the flipping force fine controller shown in FIG. 10.

FIG. 11A illustrates a mechanism under an adjustment operation; and FIG. 11B illustrates a normal state of the mechanism under no adjustment operation. A housing 323 is incorporated in a notch of mounting board 91. An adjustment pick-up 322 as one example of an adjustment portion and a gear 325 integrally formed with adjustment pick-up 322 are incorporated in housing 323. In the figure, a reference numeral 324 designates an actuating spring whose restoring force actuates adjustment pick-up 322 to the right in the figure. In the normal state, as shown in FIG. 11B, engagement teeth 321 of adjustment pick-up 322 and engagement teeth 320 of housing 323 mesh with each other, so that adjustment pick-up 322 cannot turn. Also, at the outer periphery of rotating member 88*a* is provided a gear which meshes gear 325.

In order to adjust the flipping force, the clerk in the game house disengages both engagement teeth 321 and 320 to turn adjustment pick-up 322, as shown in FIG. 11A. Accordingly, gear 325 turns integrally with adjustment pick-up 322, thereby to turn rotating member 88*a*. Since rotating member 88*a* is in mesh with semicircular gear 87 shown in FIG. 6, rotation of rotating member 88*a* enables semicircular gear 87 to turn, whereby the displacement amount of the spring for applying the flipping force to flipping hammer 84 can be adjusted. The flipping force is thus adjusted. Reference numeral 324 and engagement teeth 320, 321 form a shooting force fixing means.

Figure 12:
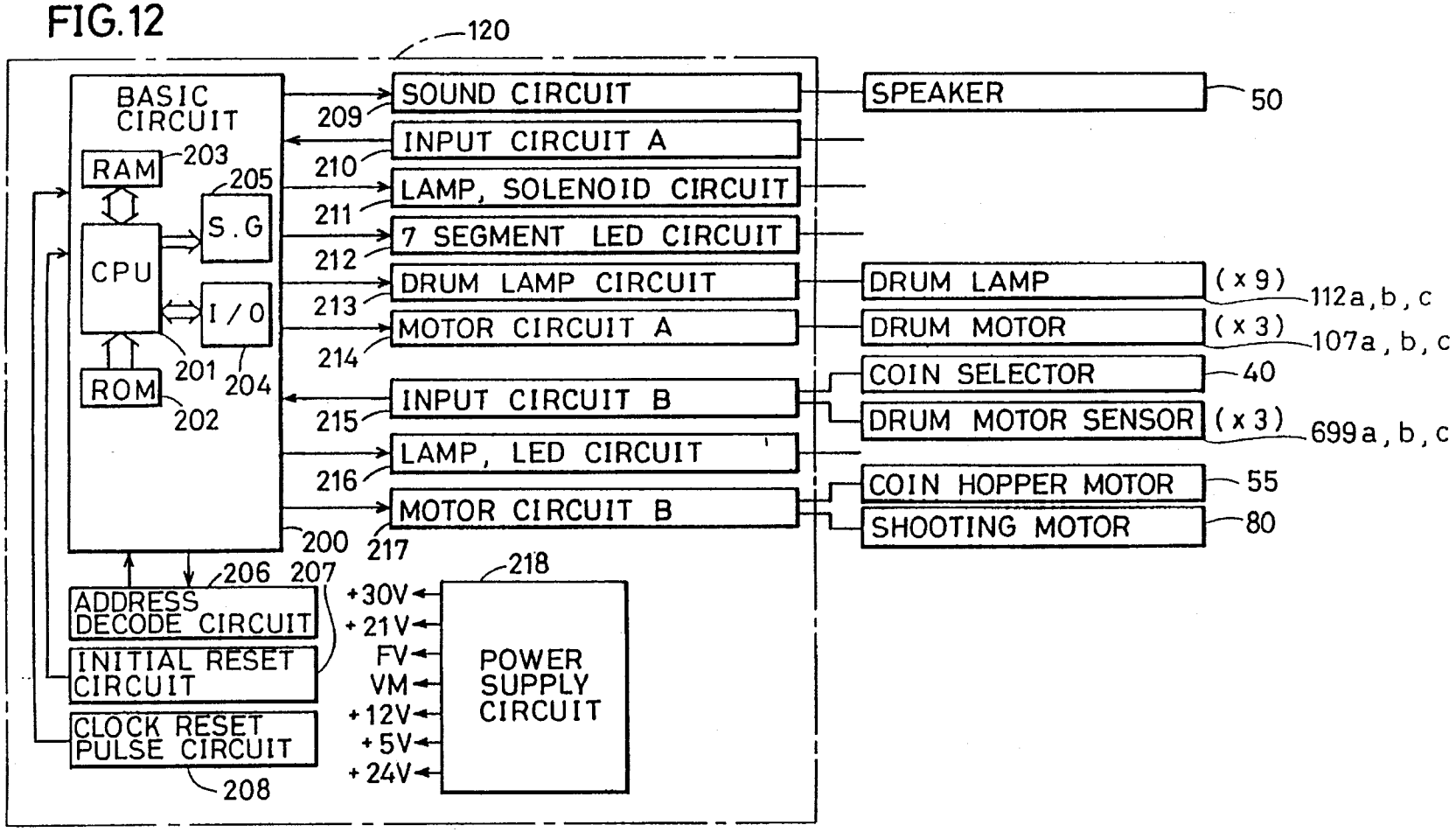
FIG. 12 is a block diagram showing a control circuit used in the flipped ball game machine.
Figure 13:
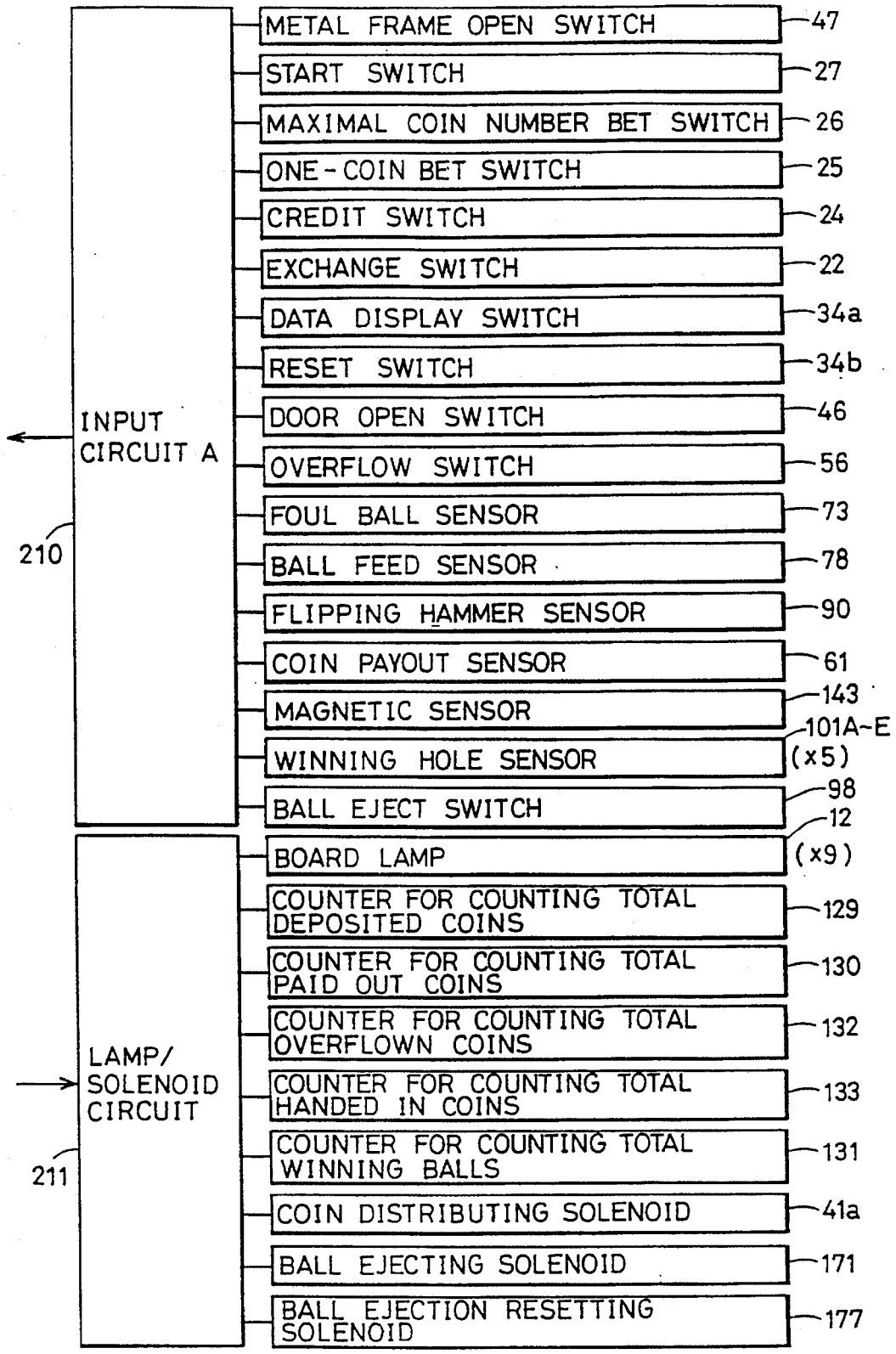
FIG. 13 is a block diagram showing a control circuit used in the flipped ball game machine.
Figure 14:
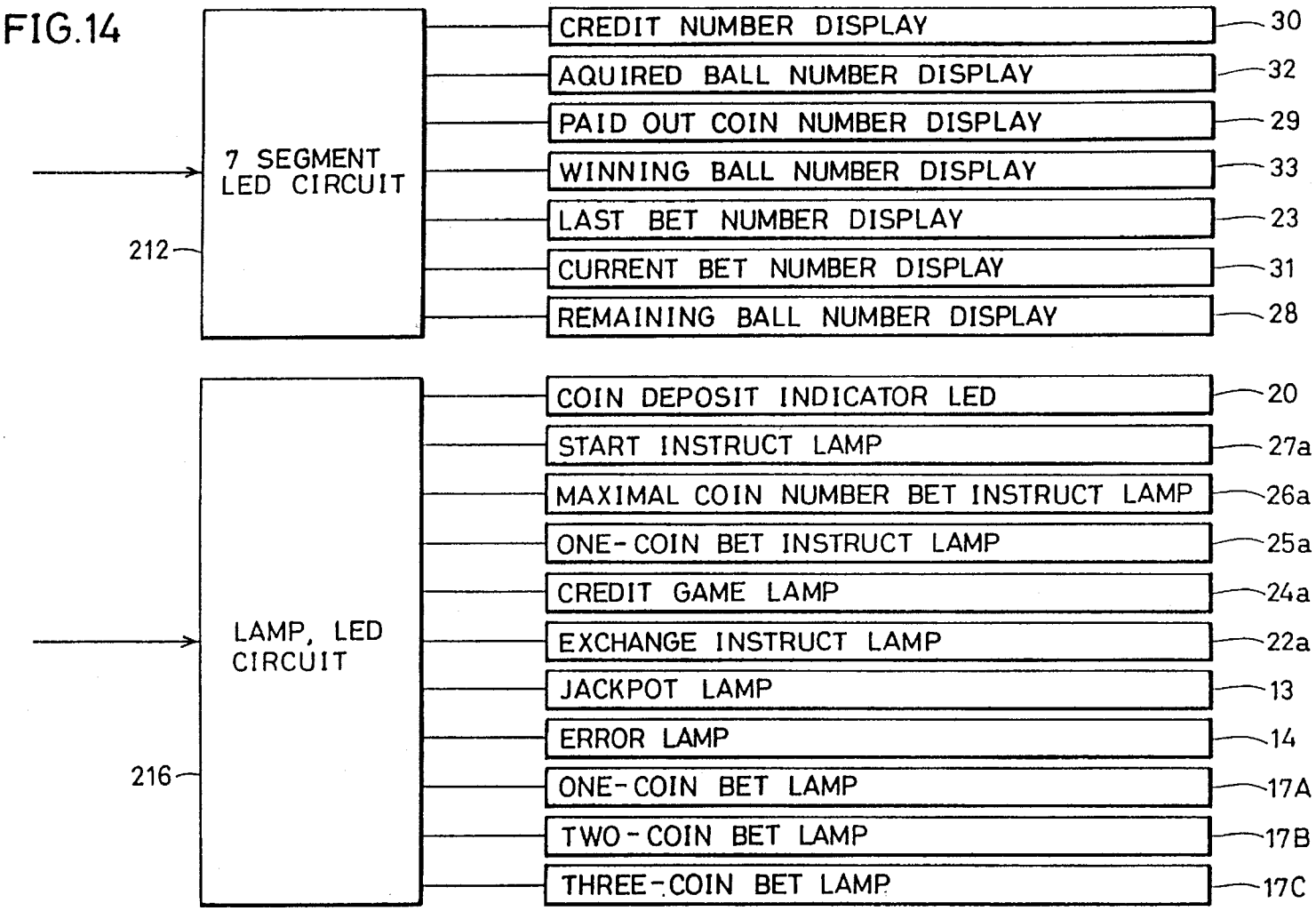
FIG. 14 is a block diagram showing a control circuit used in the flipped ball game machine.

FIGS. 12–14 are block diagrams showing control circuitry for use in the game machine.

A control circuit of the game machine includes a basic circuit 200 for controlling games in accordance with a program for controlling respective apparatuses. To basic circuit 200 are connected: an initial reset circuit 207 for resetting basic circuit 200 at the time of turning on of the power supply; an address decode circuit 206 for decoding an address signal supplied from basic circuit 200 and outputting a signal for selecting either one of an ROM 202, an RAM 203, an I/O port 204, a sound generator 205 and the like included in basic circuit 200; and a clock reset pulse circuit 208 for supplying a reset pulse for a clock to basic circuit 200. Also, the control circuit is provided with a power supply circuit 218 in which a plural kinds of DC voltages are generated.

A sound control signal from basic circuit 200 is supplied to a sound circuit 209 thereby to emit a sound from a speaker 50. Respective detect signals from metal frame open switch 47, start switch 27, maximal coin number bet switch 26, one-coin bet switch 25, credit switch 24, exchange switch 22, data display switch 34*a*, reset switch 34*b*, door open switch 46, overflow switch 56, foul ball sensor 73, ball feed sensor 78, flipping hammer sensor 90, coin payout sensor 61, magnetic sensor 143, winning hole sensors 101A–101E, and ball eject switch 98 are input to basic circuit 200 through an input circuit A210. Data display switch 34*a* and reset switch 34*b* are incorporated in key switch 34. As described above, by inserting the given key into key switch 34 for switching to the data display mode, data display switch 34*a* detects that operation to input a detect output to basic circuit 200, while by switching key switch 34 to the reset mode, reset switch 34*b* detects that operation to input a detect signal to basic circuit 200. Coin payout sensor 61 serves to detect coins paid out to coin payout outlet 37 from coin hopper 54, in which a detect signal is input to basic circuit 200 upon detection of every coin.

A lamp, solenoid drive instruct signal is input to a lamp, solenoid circuit 211 from basic circuit 200. From lamp, solenoid circuit 211 is supplied a display control signal to board lamp 12 and counters 129, 130, 132, 133, and 131, respectively. A solenoid excite control signal is respectively supplied to a coin distributing solenoid 41*a*, ball ejecting solenoid 171, and ball ejection resetting solenoid 177. Coin distributing solenoid 41*a* is provided in coin distributor 41, wherein whether or not the deposited coins are stored in hopper 54 or collected out of the machine is determined by controlling to excite coin distributing solenoid 41*a*, as discussed above.

A display instruct signal is supplied from basic circuit 200 to 7 segment LED circuit 212, while a display control signal is respectively supplied from 7 segment LED circuit 212 to credit number display 30, acquired coin number display 32, payout coin number display 29, winning ball number display 33, last bet number display 23, current bet number display 31, and remaining ball number display 28.

A lamp control instruct signal is supplied from basic circuit 200 to a drum lamp circuit 213 from which a lamp turn-on control signal is respectively supplied to drum lamps 112*a*, 112*b*, and 112*c*. A motor control instruct signal is supplied from basic circuit 200 to a motor circuit A214 from which a drum control signal is respectively supplied to drum motors 107*a*, 107*b*, and 107*c*.

A coin detect signal from coin selector 40 and a signal for detecting a rotary reference position of drum motor from drum motor sensors 699*a*, 699*b*, and 699*c* are input to basic circuit 200 through input circuit B215. Drum motor sensors 699*a*–699*c* are contained in drum motors 107*a*–107*c*.

A lamp, LED display instruct signal is supplied from basic circuit 200 to a lamp, LED circuit 216 from which a display control signal is respectively supplied to a deposit instruct LED 20, a start instruct lamp 27*a*, a maximal bet instruct lamp 26*a*, a one-coin bet instruct lamp 25*a*, a credit game lamp 24*a*, an exchange instruct lamp 22*a*, jackpot lamp 13, error lamp 14, one-coin bet lamp 17A, two-coin bet lamp 17B, and three-coin bet lamp 17*c*. Start instruct lamp 27*a*, maximal bet instruct lamp 26*a*, one-coin bet instruct lamp 25*a*, credit game lamp 24*a*, and exchange instruct lamp 22*a* are respectively incorporated in start switch 27, maximal coin number bet switch 26, one-coin bet switch 25, credit switch 24, and exchange switch 22, respectively.

A motor control instruct signal is supplied from basic circuit 200 to a motor circuit B217 from which a motor control signal is respectively supplied to coin hopper motor 55 and shooting motor 80. Reference 120 in FIG. 12 designates main board (see FIG. 3) on which basic circuit 200 and various circuits are provided, as shown in FIG. 12.

Figure 15A:
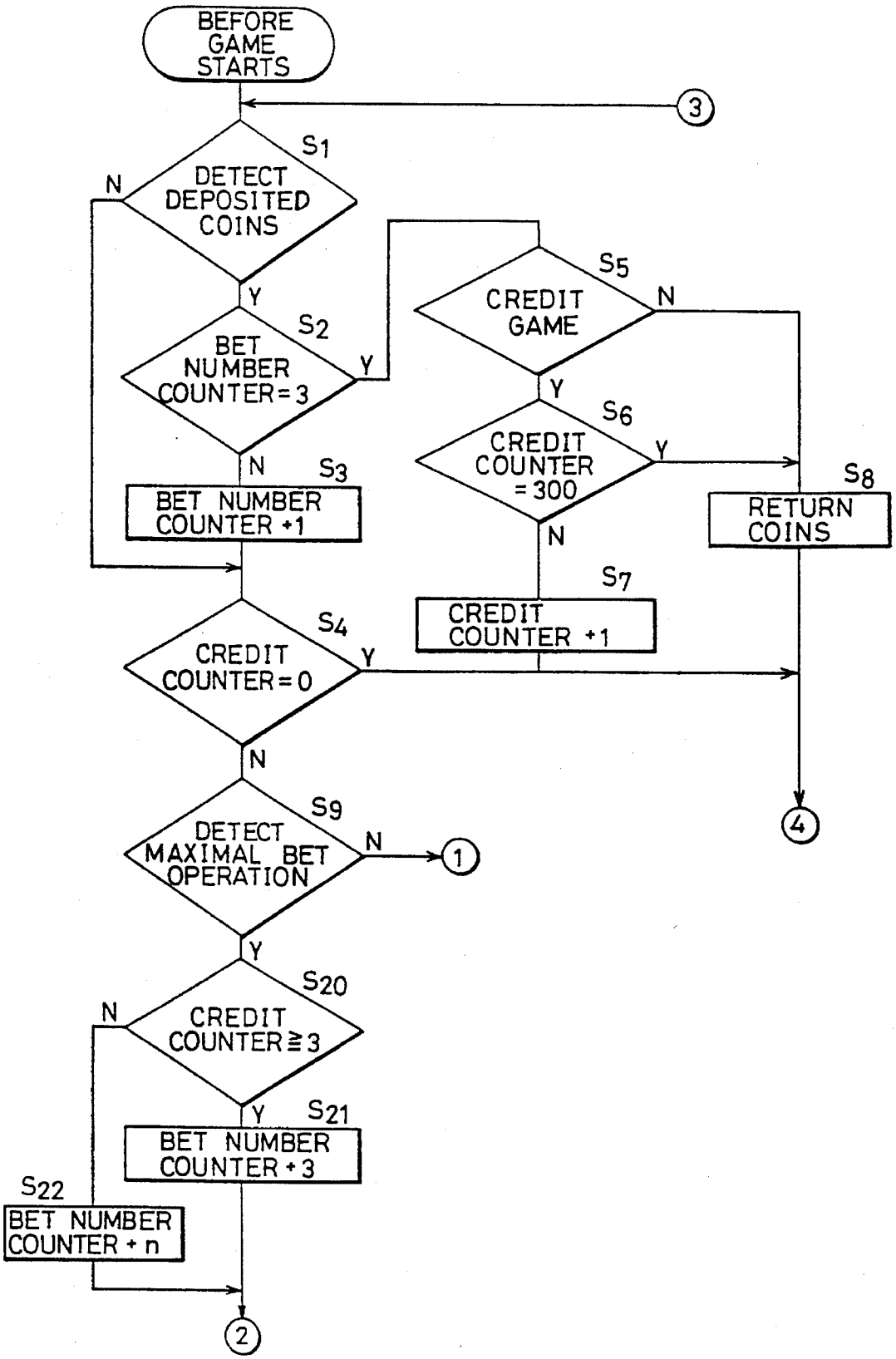
FIGS. 15A and 15B are flow charts for use in explaining an operation of the control circuit shown in FIGS. 12–14.
Figure 15B:
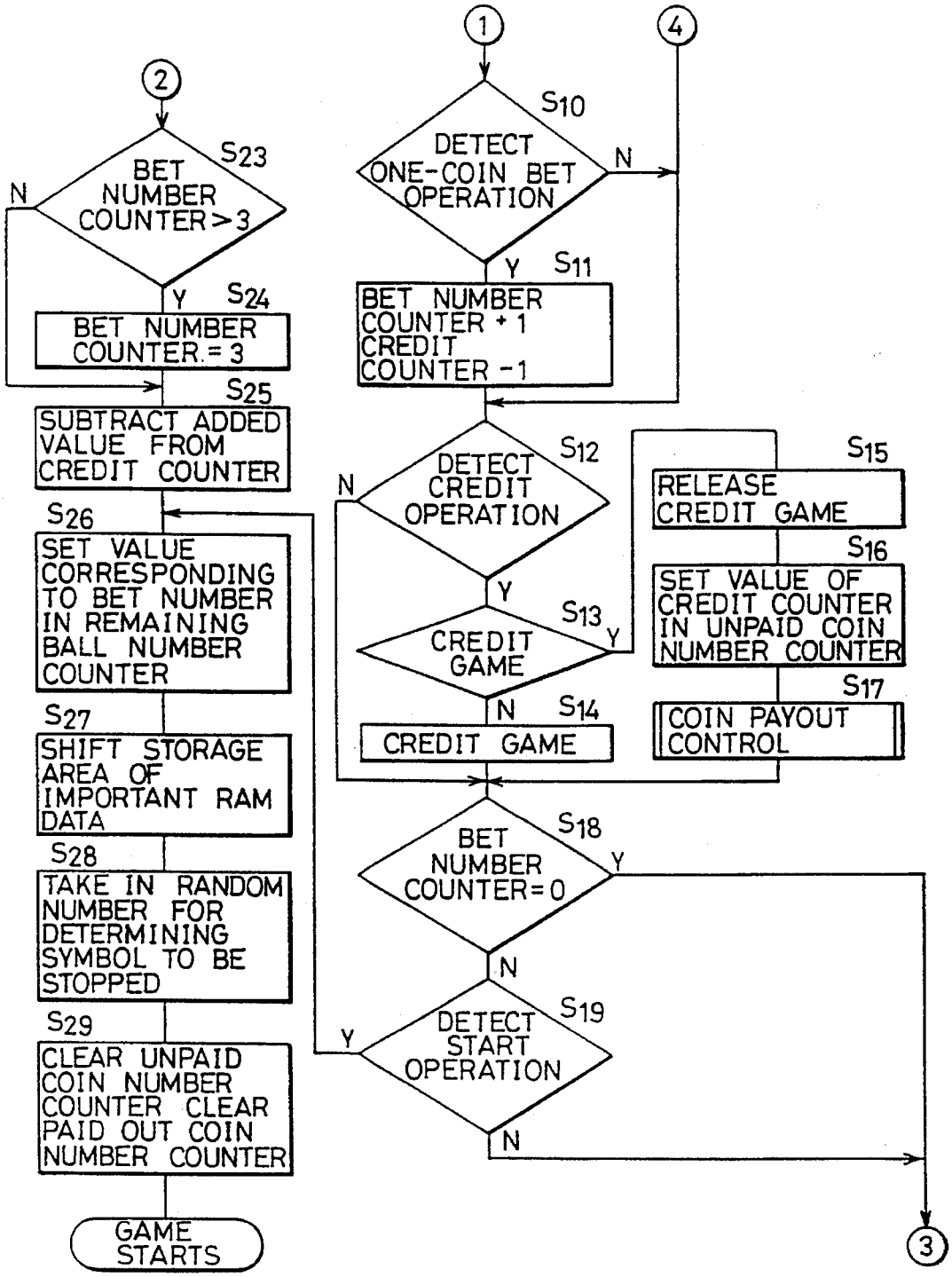
Figure 16A:
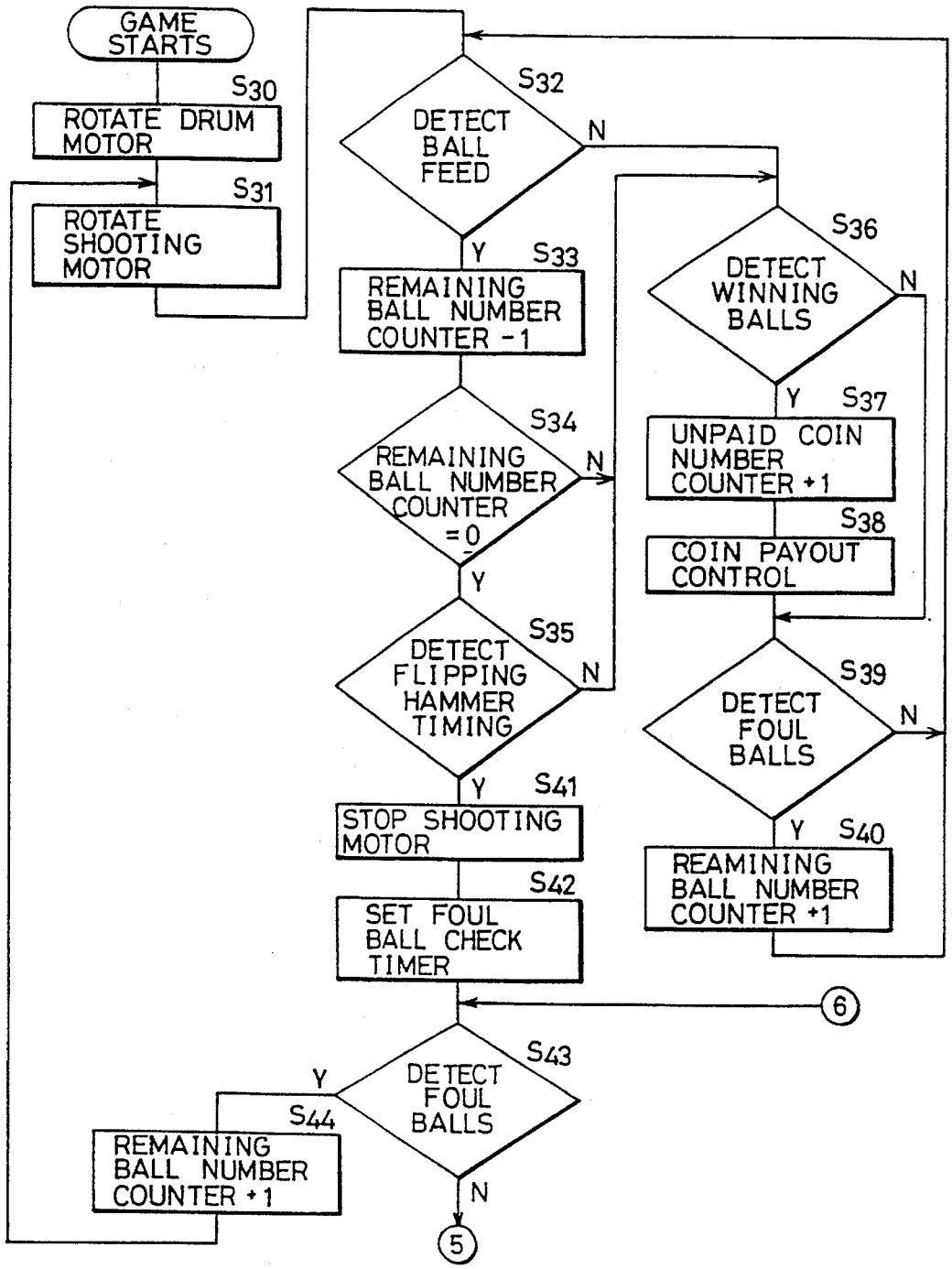
FIGS. 16A and 16B are flow charts for use in explaining an operation of the control circuit shown in FIGS. 12–14.
Figure 16B:
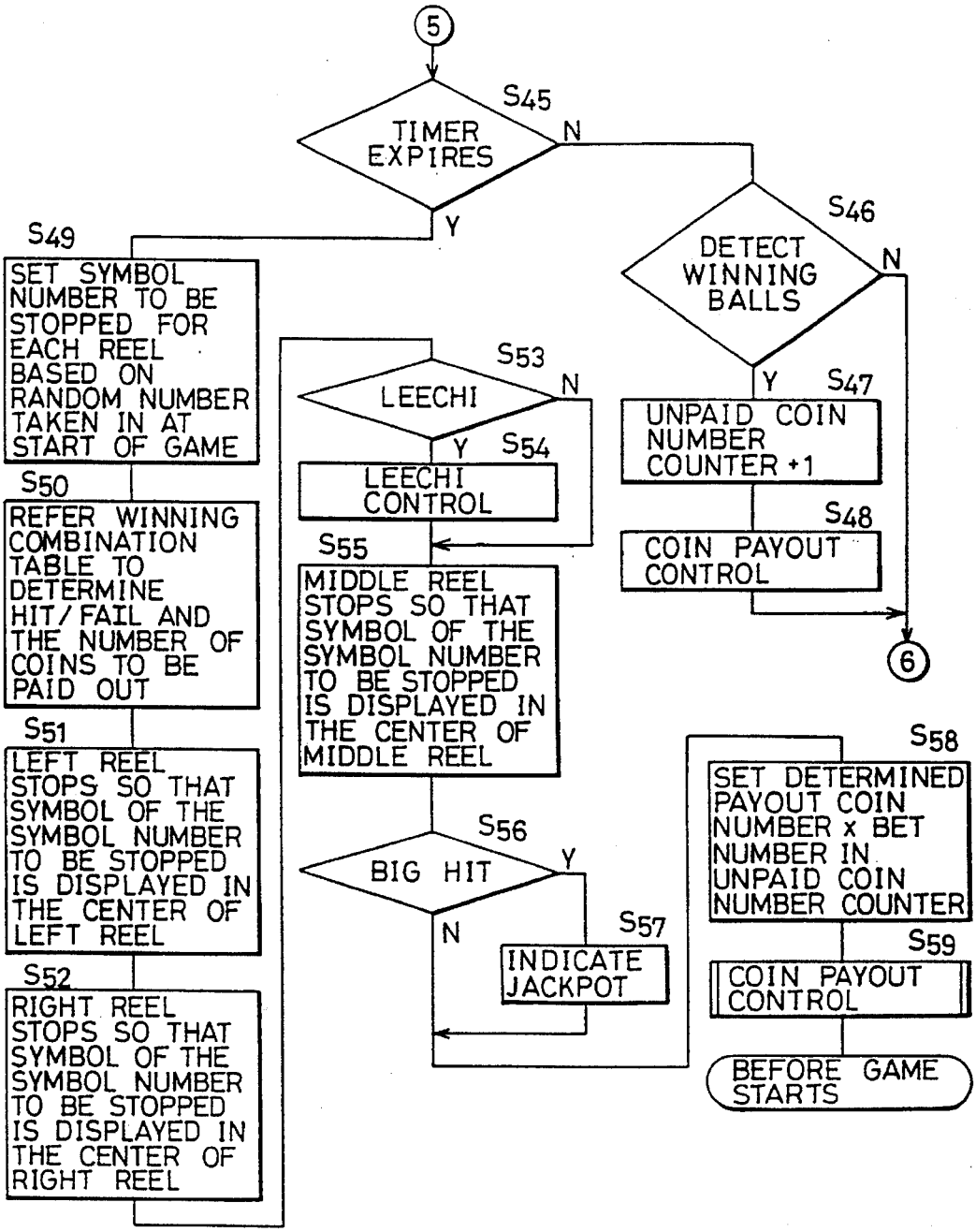
Figure 17:
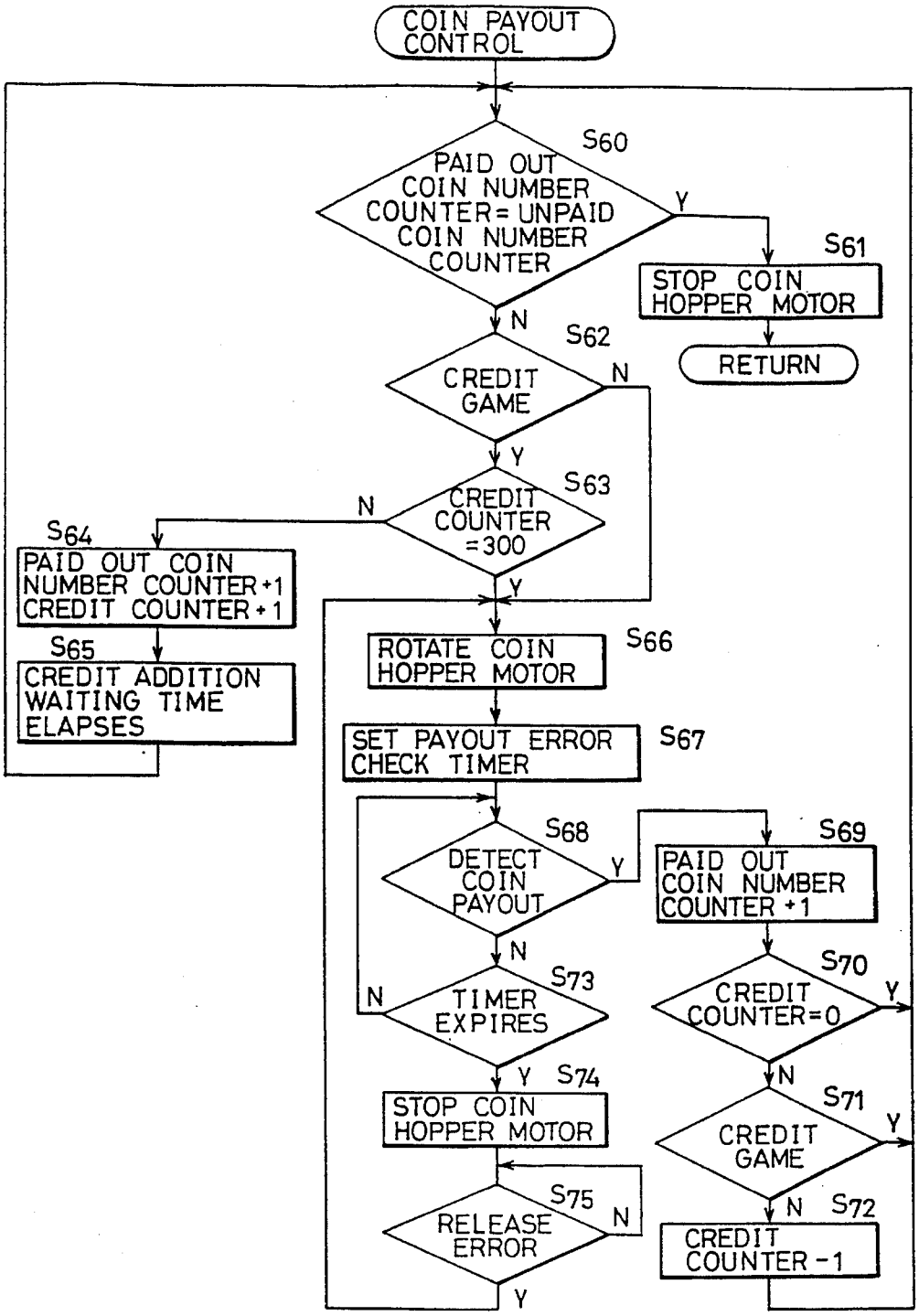
FIG. 17 is a flow chart for use in explaining an operation of the control circuit shown in FIGS. 12–14.
Figure 18:
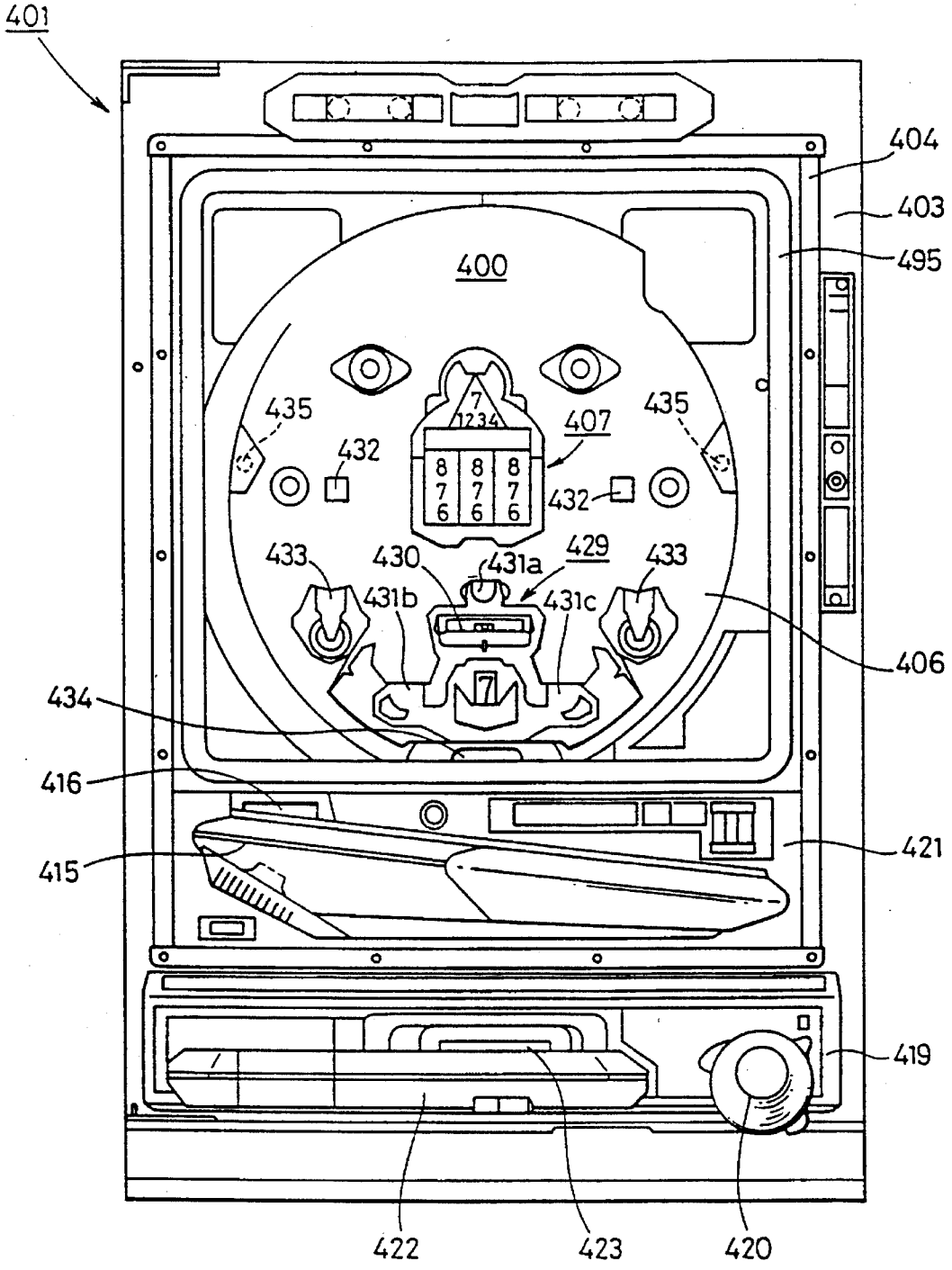
FIG. 18 PRIOR ART
FIG. 18 is an overall front view showing a PACHINKO game machine as an example of a conventional flipped ball game machine.
Figure 19:
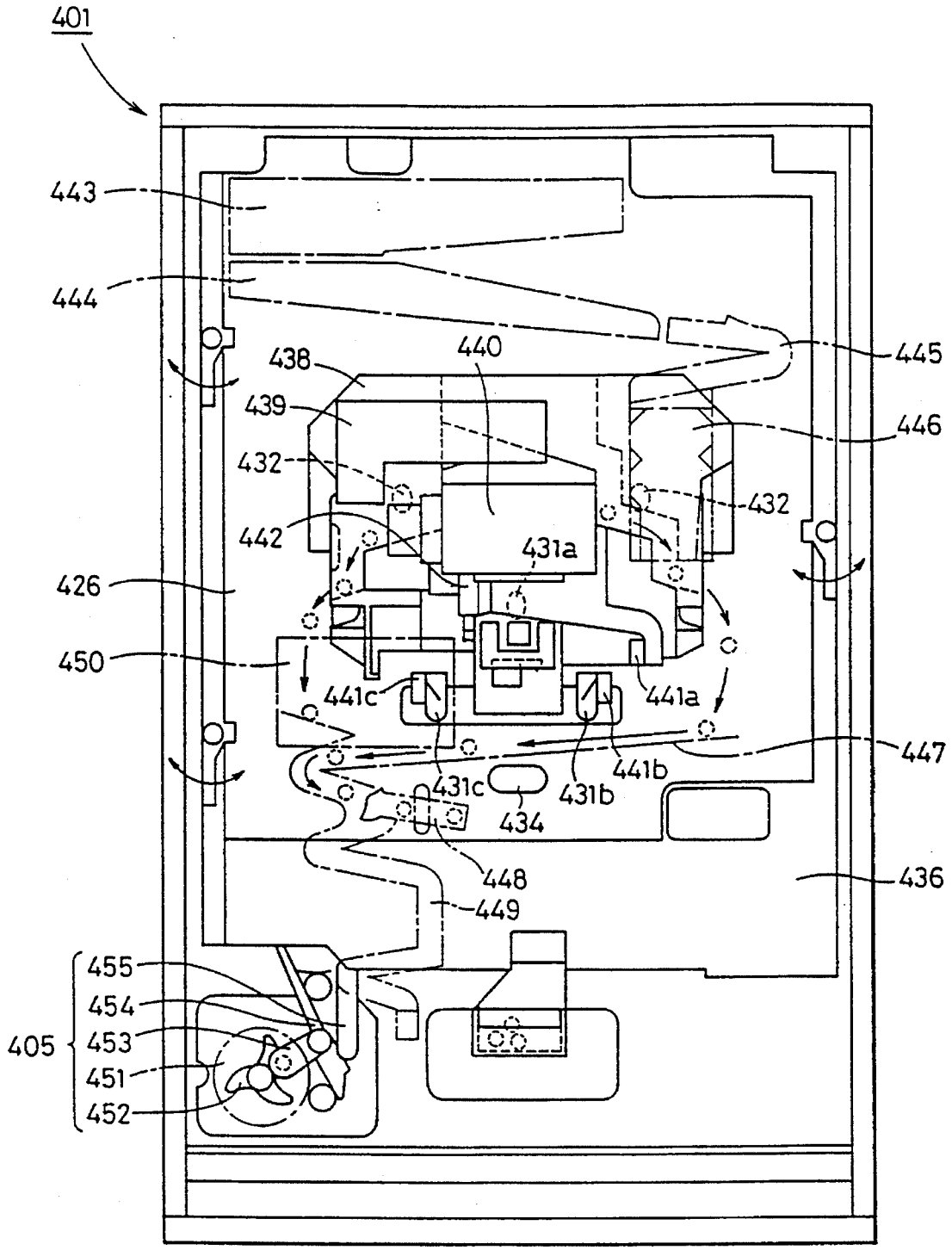
FIG. 19 PRIOR ART
FIG. 19 is an overall rear view showing a part of an internal structure of the conventional PACHINKO game machine.
Figure 20:
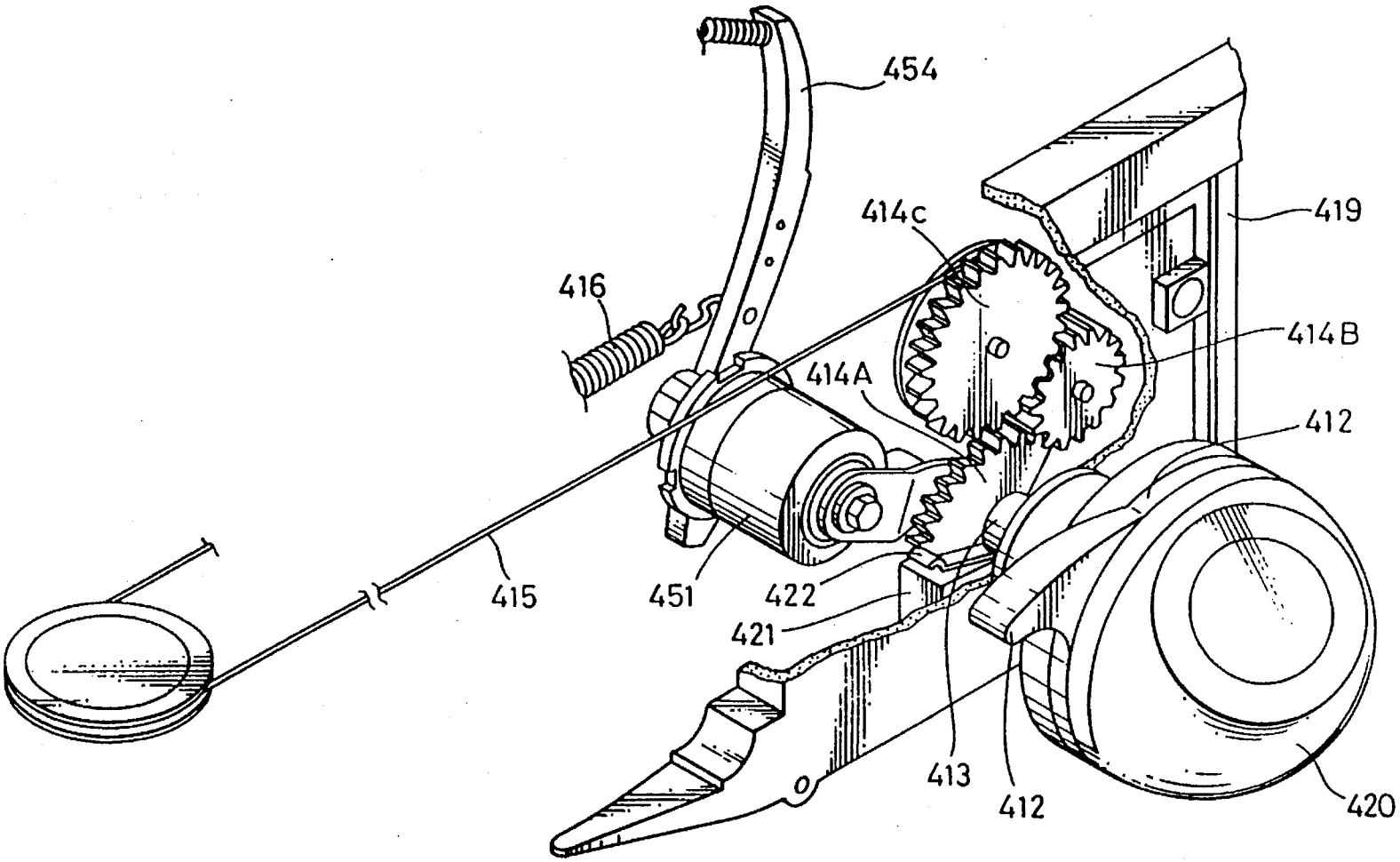
FIG. 20 PRIOR ART
FIG. 20 is a perspective view showing a ball shooting mechanism provided in the conventional PACHINKO game machine.

FIGS. 15–17 are flow charts for use in explaining the operation of the control circuit shown in FIGS. 12–14.

First, a determination is made as to whether or not a deposited coin is detected in step (hereinafter referred merely to as "S") 1. If it is not, the control proceeds to S4. If the player deposits a coin through coin deposit slot 18 (see FIG. 1), the deposited coin is detected by coin selector 40, so that the control proceeds to S2. Coin deposit slot 18, coin selector 40 and S1 form a valuable object using operation determining means. Coin selector 40 and S1 form a value detecting means. In S2, a determination is made as to whether or not a bet number counter indicates "3". The bet number counter serves to count the number of bet coins set and input by the player by operating one-coin bet switch 25 or maximal bet switch 26 in the credit game, or to count the number of the deposited coins in the coin-operated game. The player can bet up to "3" at maximum as described above. The value of the bet number counter is updated into a predetermined value in respective steps of S3, S11, S21, S22, and S24 which will be described later, and after one game is over, the resultant count value is cleared.

If the count value of the bet number counter is not "3" yet, this means that the bet number counter is capable of being added so that a processing of adding "1" to the count value of the bet number counter, corresponding to the deposit of coins, is carried out in S3. S2 and S3 form a received value setting means. On the other hand, if the count value of the bet number counter is already the maximal value of "3", the control proceeds to S5 in which a determination is made as to whether a credit game is to be played or not. More specifically, the deposit of coins despite the fact that the count value of the bet number counter is already the maximal value of "3" can be considered that the player intends to play the credit game in which the player deposits a large number of coins in advance and then credits the deposited coins to play the game repetitively. Thus, the determination is first made as to whether or not the game to be played is the credit game in S5. If the credit game is not determined in S5, then the coins deposited exceeding an upper limit value of the bet number are returned to the player in S8, and the control proceeds to S12. On the other hand, if the credit game is determined, the control proceeds to S6 in which a determination is made as to whether or not the count value of a credit counter reaches an upper limit value of "300". If the count value is not the upper limit value of "300" yet, indicating that the credit counter is capable of being added, then a processing of adding "1" to the count value of the credit counter, corresponding to the number of coins deposited, is made in S7, and thereafter the control proceeds to S12. S7 forms a value storing means.

On the other hand, if the count value of the credit counter is already the upper limit value of "300", the control proceeds to S8, then the coins deposited exceeding the upper limit value of the credit counter are returned, and thereafter the control proceeds to S12.

Now, the description will be made as to the flow of control when the player deposits a coin to start a game of the usual game mode initiated by deposit of coins, rather than the credit game mode. In this case, since the count value of the credit counter is already "0", a determination of YES is made in S4. Then, the control proceeds to S12 where a determination of whether or not the credit operation is detected is made. If the player does not operate credit switch 24, the control proceeds to S18 to determine whether or not the count value of the bet number counter is "0". The count value of the bet number counter is not "0" after the processing of S3 if the player has already deposited a coin, whereby the control proceeds to S19 where a determination is made as to whether or not the start operation is detected. If it is not detected, the control returns to S1. Then, the player's pressing start switch 27 enables a determination of YES in S19, so that the control proceeds to S26 where the succeeding game starting control is carried out.

On the other hand, if the player presses credit switch 24 in the usual coin-operated game mode, a determination of YES is made in S12 so that the control proceeds to S13 to determine whether or not the game mode is already the credit game. If the game mode is not the credit game mode, the control proceeds to S14 where the game mode is switched to the credit game mode and the control proceeds to S18. When the game mode is already the credit game mode, if the player presses credit switch 24 again, a determination of YES is made in S12 and S13 so that the control proceeds to S15 where the credit game mode is released to restore the usual coin-operated game mode. Then, a processing of setting the count value of the credit counter in an unpaid coin number counter in S16 is carried out. The unpaid coin number counter serves to count the number of coins to be paid out. Then, the control proceeds to S17 where the number of coins corresponding to the count value of the unpaid coin number counter are paid out, and then the control proceeds to S18.

If the count value of the credit counter is not "0" in the credit game mode, the control proceeds to S9 where a determination is made as to whether or not the maximal bet operation is detected. If it is not detected, the control proceeds to S10 where a determination is made as to whether or not the one-coin bet operation is detected. If it is not detected, the control proceeds to S12. If the player intends to play the one-coin bet game in the credit game mode, the player can press one-coin bet switch 25. Then, a determination of YES is made in S10 to proceed the control to S11 where "1" is added to the count number of the bet number counter and "1" is subtracted from the count value of the credit counter, and thereafter the control proceeds to S12.

The player's pressing start switch 27 enables a determination of YES in S19, thereby to proceed the control to S26.

If the player intends to play the two-coin bet game in the credit game mode, the player presses one-coin bet switch 25. Accordingly, a determination of YES is made in S10, and the control proceeds to S11 where processings of adding "1" to the count value of the bet number counter and subtracting "1" from the count number of the credit counter are carried out, and thereafter the control proceeds to S12. Then, the player presses one-coin bet switch 25 again without pressing start switch 27. Then, a determination of NO is made in S19 so that the control returns to S1 and a determination of YES is made in S10 to enable a processing of S11. The resultant count value of the bet number counter is "2". At this time, start switch 27 is pressed to proceed the control to S26.

If the player intends to play the maximal coin number bet game (the three-coin bet game), the player presses the maximal bet switch 26. Then, a determination of YES is made in S9 so that the control proceeds to S20 to determine whether or not the count value of the credit counter is "3" or more. If the count value is "3" or more, the control proceeds to S21 where a processing of adding "3" to the count value of the bet number counter is carried out, and thereafter control proceeds to S23. On the other hand, if the count value of the credit counter is less than "3", because of the fact that the number of coins stored as a credit is less than 3 although the three-coin bet game is selected, a processing of adding n (1 or 2) to the count value of the bet number counter is made in S22 and the control proceeds to S23. More particularly, the current count value (1 or 2) of the credit counter is added to the count value of the bet number counter in S22.

In S23, if the value of the bet number counter >3 is determined. When 1–3 coins are deposited or the one-coin bet operation is made for the purpose of playing the usual coin-operated game instead of the credit game, the count value of the bet number counter is already either one of 1, 2, and 3. At this time, if the player presses the maximal bet switch 26, "3" is further added to the count value of the bet number counter which is already indicating 1, 2 or 3 (S21), whereby the count value of the bet number counter could exceed "3". In that case, YES is determined in S23, and the control proceeds S24 where the count value of the bet number counter is made "3", while the added value to the count number of the bet number counter is subtracted from the count value of the credit counter in S25, and thereafter the control proceeds to S26. More specifically, if the credit game is currently played, and the operation for playing the maximal bet (three-coin bet) game of the usual coin-operated game is carried out with one coin, for example, being already deposited, that one coin is added to the count value of "2" of the credit counter corresponding to two coins, thus satisfying 1+2=3, resulting in the count value of "3" in the bet number counter. The control also proceeds to S25 when NO is determined in S23. In this case, however, "3" is subtracted from the count value of the credit counter because the added value is "3". Coin deposit slot 18, coin selector 40 and S1–S25 form a starting condition determining means for determining whether or not game starting conditions necessary to start a game are satisfied. S9–S11 and S20–S25 form a stored value drawing and setting means. Coin deposit slot 18, coin selector 40, S1–S3, S9–S11 and S20–S25 form a bet number setting means. S4 and S9–S25 form a game repetition allowing means for allowing repetition of said one-unit game with satisfaction of allowing conditions satisfied under such a necessary condition that the remaining value stored in said value storing means is equal to or higher than the value necessary to play said one-unit game, said one-unit game being played by using the value stored in the value storing means.

Now, in S26 a processing for setting in the remaining ball number counter the value corresponding to the bet number is made. For instance, "5", "10", and "15" are respectively set in the remaining ball counter in the cases of the one-coin bet, the two-coin bet, and the three-coin bet. The remaining ball counter serves to count the number of PACHINKO balls available for shooting in one game, such that the number of PACHINKO balls equivalent to this count value can be flipped into play field 6A in one game. In S27, a processing of shifting a storage area of important RAM data is made. The important RAM data represent the data important for use in a game out of various data stored in RAM 203. Such data include a hit flag (a flag which stores a determination result of whether or not a hit is to be generated according to random numbers for determining symbols to be stopped, which will be described later, and also stores contents of the hit determined by the random numbers for determining symbols to be stopped), the number of coins paid out, the bet number, the credit number, a stopped symbol number of each reel, the number of winning balls fell into winning holes and the variable winning ball apparatus, and an extracted value from the random numbers for determining symbols to be stopped of up to 2 games prior to the current game. The data further include the hit flag, the number of coins to be paid out, the symbol number of each reel to be stopped, the bet number, and the number of winning balls of the current game. By shifting the storage area of the important RAM data, the current data such as the hit flag of the game is shifted to the data of the game which is two games prior to the current game such as the hit flag of that game.

In S28, the random numbers for determining symbols to be stopped are taken in. Such random numbers are calculated once for every interruption (every 2 msec or 1 msec) by input of a reset pulse signal supplied from clock reset pulse circuit 208. Such a calculation can be expressed as, for example, $X(i)=a\cdot X(i-1)+b$. Although the calculation of the random numbers is made once for every interruption as described above, the number of updating is changed by means of a refresh counter or the like at the end of playing one game in order to prevent generation of a certain rule in updating random numbers. Then, the random number is taken in synchronism with the start of the game in S28. The basic circuit and S28 form a random number generating means. In S29, the unpaid coin number counter and the paidout coin number counter are cleared, whereby the control of the game start is conducted as shown in S30 and the succeeding steps in FIG. 16.

The rotation of the drum motor is controlled in S30 of FIG. 16A. As a result, respective drums 105*a*, 105*b*, and 105*c* start rotating. Then, rotation of the shooting motor is controlled in S31, whereby the number of PACHINKO balls set in the remaining ball number counter in S26 are flipped into play field 6A. S31 forms a ball shooting automatically controlling means. Thereafter, the control proceeds to S32 where a determination is made as to whether or not ball feed is detected. If it is not detected, then a determination is made as to whether or not a winning ball is detected in S36. If the winning ball is not detected, then a determination is made as to whether or not a foul ball is detected in S39. If the foul ball is not detected, then the control returns to S32. If the ball feed is detected by ball feed sensor 78 (see FIG. 6), the control proceeds to S33 where "1" is subtracted from the count value of the remaining ball number counter, and a determination is made as to whether or not the count value of the remaining ball counter is "0" in S34. If it is not, the control proceeds to S36. S33 forms a counting means. When the number of PACHINKO balls set in S26 are detected by ball feed sensor 78, YES is determined in S34 so that the control proceeds to S35 where a determination is made as to whether or not the flipping hammer timing is detected. The detection of the flipping hammer timing is based on a detect signal supplied from flipping hammer sensor 90. The control proceeds to S36 as long as the flipping hammer timing is not detected yet. On the other hand, when the flipping hammer timing is detected and the last PACHINKO ball is in the shooting position, the control proceeds to S41 where the flipping motor is stopped and the shooting of balls is finished. S35 and S34 form a ball shooting stopping means. If the winning ball is generated in one game, YES is determined in S36, whereby "1" is added to the count number of the unpaid coin number counter in S37, thus controlling payout of one coin based on the winning ball in S38.

Next, the control proceeds to S39 where a determination is made as to whether or not the foul ball is detected. If the foul ball is detected by foul ball sensor 73 (see FIG. 6), then the control proceeds to S40 where "1" is added to the count value of the remaining ball number counter, whereby the control returns to S32. More specifically, when the foul ball is returned without reaching play field 6A despite of the subtraction processing in S33 by flipping the ball into play field 6A, that foul ball has to be flipped into play field 6A again. In this respect, the addition processing is conducted in S40 so that values are offset each other to result in 0.

After the flipping motor is controlled to be stopped in the above-described S41, a foul fall check timer is set in S42. The foul ball check timer is used to measure a waiting time before detecting a foul ball which is the last ball of the game flipped and is returned as the foul ball without reaching play field 6A. After a determination is made as to whether or not the foul ball is detected in S43, if the foul ball is not yet detected, the control proceeds to S45 to determine whether or not the foul ball detection timer expires. If the timer does not expire yet, the control proceeds to S46 where a determination is made as to whether or not the winning ball is detected. If it is not detected, the control returns to S43. In the course of a loop cycle from S43 to S46, the control proceeds to S49 at the time when the foul ball check timer expires. However, if the foul ball is detected before the timer expires, the processing of adding "1" to the count value of the remaining ball number counter is carried out due to the same reason as before so that the control returns to S31, whereby the number of balls corresponding to the addition result can be flipped. On the other hand, if the winning ball is generated in the course of the loop cycle, YES is determined in S46 so that the control proceeds to S47 where "1" is added to the unpaid coin number counter, whereby payout control of coins as described above is conducted in S48. S1–S48 form an one-unit game allowing means.

In S49, the symbol number to be stopped for each reel is set based on the random number which is taken in at the beginning of the game. S49 forms a display result determining means. There are a plural kinds of symbols to be stopped for each reel corresponding to the random numbers. Thus, the symbol number to be stopped corresponding to the taken-in random number is set in S49. Since 21 symbols are variably displayed at respective variable display portions 8A, 8B and 8C of variable display apparatus 7, 256 random numbers are assigned to those 21 symbols. The number of random numbers assigned to the plural kinds (21) of symbols to be stopped cannot be the same for each symbol. In other words, some symbols correspond to many random numbers, while other symbols only correspond to a few random numbers. As a result, an occurrence probability of the symbols which correspond to many random numbers is high, and conversely the occurrence probability of the symbols which only correspond to a few random numbers is low. Then, the control proceeds to S50 where a determination is made as to whether or not the symbol number set in S49 is a hit with reference to a winning combination table. If there is a hit, the number of coins to be paid out is determined. The control then proceeds to S51 where the left reel is controlled to be stopped so that a symbol of the symbol number to be stopped is displayed in the center of the left reel, i.e., in the middle section of the vertically rotating variable display portion 8A. The right reel is controlled to be stopped so that a symbol of the symbol number to be stopped is displayed in the center of the right reel, i.e., in the middle section of the variable display portion 8B in S52.

The control proceeds to S53 where a determination is made whether or not LEECHI is satisfied. LEECHI represents such a state that while the part of the plurality of variable display portions are still changeably displaying, the display result of the variable display portions which are already stopped satisfies the display condition capable of generating a specific combination of symbols by which a hit occurs. If LEECHI is not satisfied, the control proceeds to S55. Conversely, if LEECHI is satisfied, the control proceeds to S54 where LEECHI control is carried out, and the control proceeds to S55. In the LEECHI control, the lamp or the LED is turned on or flashes to indicate occurrence of LEECHI, and a predetermined sound effect is generated from the speaker to indicate occurrence of LEECHI; or the speed of variable display of variable display portion 8*c* which is to stop lastly is decreased such that the variable display portion 8*c* is stopped after rotating for a relatively long time period.

The control proceeds to S55 where the middle reel is controlled to be stopped so that a symbol of the symbol number to be stopped is displayed in the center of the middle reel, i.e., in the middle section of the vertically rotating variable display portion 8*c*. S51–S55 form a display controlling means for controlling said variable display apparatus so as to display the display result determined by the display result determining means. The basic circuit, S28 and S49–S55 form a variable display controlling means. Then, a determination is made as to whether or not a big hit occurs in S56. If the big hit does not occur, the control proceeds to S58; conversely, if the big hit occurs, jackpot is indicated in S57 so that jackpot lamp 13 is turned on or flashes. In S58, the determined number of coins to be paid out×the bet number is set in the unpaid coin number counter, whereby the set number of coins are controlled to be paid out in S59. Thereafter, the control returns to S1. As described above, the variable display apparatus can draw and display the display result in S51, S52, and S55 after all balls are flipped thereby indicating "0" in the remaining ball number counter. Therefore, as long as there are remaining balls to be flipped, the player can focus only on trajectories of flipped balls. In the meanwhile, the player can focus on the display result of the variable display apparatus after all balls are flipped. S42–S48 form a remaining ball winning value providing means. S45 forms a value provision prohibiting means after elapse of a predetermined period. S58 and S59 form a display result value providing means. S36–S48 and S59 form a value providing means.

FIG. 17 is a flow chart showing a subroutine program for controlling payout of coins shown in S17, S38, S48 and S59.

In S60, a determination is made as to whether or not count values of the payout coin number counter and the unpaid coin number counter match. If there is not a match, the control proceeds to S62 where a determination is made as to whether or not the credit game is played. The control proceeds to S66 if the credit game is not to be played. However, the control proceeds to S63 if the credit game is to be played, such that a determination is made as to whether or not the count value of the credit counter is its maximum value of "300". If it is not "300", the control proceeds to S64 where the count values of the payout coin number counter and the credit counter are respectively incremented by "1". The control then proceeds to S65 where the waiting time of credit addition elapses, and then the control returns to S60. With the waiting time of credit addition in S65, the count value of the credit counter displayed in credit displayer 30 (see FIG. 1) can change slowly over the waiting time, whereby the player can visually recognize the change of the count value of the credit counter.

On the other hand, if the count value of the credit counter is "300", the control proceeds to S66 where the coin hopper motor is rotated to set a payout error check timer in S67, then a determination is made as to whether or not the payout coin is detected in S68. If the payout coin is not detected, the control proceeds to S73 where a determination is made as to whether or not the payout error check timer expires. The determination continues in S68 until the timer expires. If the payout coin is detected before the timer expires, the control proceeds S69 where "1" is added to the count value of the payout coin number counter. Then, the control proceeds to S70 where a determination is made as to whether or not the count value of the credit counter is "0". If the count number of the credit counter is "0", the control returns to S60. On the other hand, if YES is determined in S63, which means that the counter of the credit counter is not "0" and the game mode is the credit game mode, then YES is determined in S71 and the control returns S60. Further, if the count value of the credit counter is not "0" and the game mode is not the credit game mode, in other words, if coins are paid out upon release of the credit game mode, then the control proceeds to S72 where "1" is subtracted from the count value of the credit counter. After that, the control returns to S60.

As described above, in the case of the credit game mode, the processing of adding the value to the credit counter is firstly carried out instead of actual payout of coins. Once the count value of the credit counter is the maximum value of "300", the coins are controlled to be paid out actually, because no more value can be added.

In the meanwhile, if the payout coin is not detected until the payout error check timer expires, then the control proceeds to S74 where the coin hopper is stopped, and release of the error is waited in S75. YES is determined in S72 in such cases that there is no coins in the coin hopper or a coin jam occurs. When the clerk appropriately deals with the cases and carries out reset operation, YES is determined in S75 and the control returns to S66.

According to the flipped ball game machine of the present invention, when an error occurs, a cause of the error is displayed in the form of a code by means of a predetermined display. The causes of the error to be displayed include: emptiness of the coin hopper; a coin payout jam; a malfunction of the coin hopper; a coin selector jam; front frame 3 being opened (which is reset by closing front frame 3); glass door frame 5 being opened (which is reset by closing glass door frame 5); short circuit/disconnection of adjacent switch 78 of ball shooting mechanism 68; short circuit/disconnection of adjacent switches 101A–101E (winning hole sensors) of winning holes; short circuit/disconnection of adjacent switch 73 for foul ball detection; an error of ROM 202; a repairable error of RAM 203; an unrepairable error of RAM 203; low power of the battery; fraud by operating a coin with thread; and fraud by the use of a magnet.

According to the embodiments described above, the flipped ball game machine can be provided in which once the predetermined game starting condition is satisfied, balls are automatically flipped into the play field so that the falling state of the balls can be enjoyed, and at the same time the game by the variable display apparatus can also be enjoyed since the variable display apparatus is controlled to draw the display result, whereby the player can enjoy chances under less influence caused by the players skill of flipping balls.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A flipped ball game apparatus having a play field into which a ball is shot and moves leaving a indefinite trajectory, wherein a predetermined value can be provided to a player in accordance with the trajectory of the ball moving in the play field, said apparatus comprising;

ball shooting means for shooting a ball towards said play field;

a variable display apparatus including a plurality of variable display portions capable of varying a display state;

starting condition determining means for determining whether or not game starting condition necessary to start a game are satisfied;

ball shooting automatic control means for automatically driving and controlling said ball shooting means to automatically shoot a ball when said starting condition determining means determines that the game starting conditions are satisfied;

variable display controlling means for controlling said variable display apparatus to draw and display a display result when said starting condition determining means determines that the game starting conditions are satisfied;

display result value providing means for providing a predetermined value to the player when the display result of said variable display apparatus is provided in a predetermined specific display state;

wherein said variable display controlling means comprises display timing controlling means for drawing and displaying asynchronously the display results of said plurality of display members after starting variation of display of said plurality of variable display portion; and specific operation means for carrying out a specific operation appreciable by the player, different from that when not in said predetermined specific state, when in said predetermined specific state where the display result of the variable display portion, already having a display result drawn and displayed at a stage where a part of said plurality of variable display portions is still varying display, satisfies the conditions of attaining said predetermined specific display state.

2. The flipped ball game apparatus according to claim 1, wherein said variable display apparatus includes a plurality of variable display members capable of variably displaying a plural kinds of identification information.

3. The flipped ball game apparatus according to claim 2, wherein said plurality of variable display members include a rotating drum having the plural kinds of identification information provided on an outer periphery thereof.

4. The flipped ball game apparatus according to claim 3, wherein said variable display apparatus includes a motor for driving said rotating drum.

5. The flipped ball game apparatus according to claim 4, wherein said variable display apparatus includes a storage box for storing said motor and said rotating drum, and a mounting member for mounting said motor to said storage box, and wherein said storage box and said mounting member include electrical connecting means, whereby said both electrically connecting means are connected to each other with said mounting member being mounted to said storage box so that an electrical power can be supplied to said motor from a predetermined power supply via said both electrical connecting means, and the connection of said both electrical connecting means is released by removing said mounting member from said storage box.

6. The flipped ball game apparatus according to claim 1, wherein said variable display controlling means includes display result determining means for determining a display result of said variable display apparatus, and display controlling means for controlling said variable display apparatus so as to display the display result determined by the display result determining means.

7. The flipped ball game apparatus according to claim 6, wherein said variable display controlling means includes random number generating means for generating random numbers, and said display result determining means randomly determines said display result in accordance with the random numbers generated by said random number generating means.

8. The flipped ball game apparatus according to claim 1, wherein said variable display controlling means includes display result determining means for determining the display result of said variable display apparatus, and display controlling means for controlling said variable display apparatus so as to display the display result determined by the display result determining means, and wherein said display result value providing means includes determined contents identifying means for making an identification of whether or not a value can be provided for the display result determined by said display result determining means, the value being provided in accordance with the result of the identification by said determined contents identifying means indicating that the value can be provided.

9. The flipped ball game apparatus according to claim 8, wherein said determined contents identifying means includes winning display result storing means for storing a winning display result out of the display results of said variable display apparatus, by which the value can be provided to the player, and display result comparing means for comparing the display result determined by said display result determining means with the winning display result stored in said winning display result storing means, whereby said display result value providing means provides the value when the comparison of the display result determined by said display result determining means with the winning display result stored in said winning display result storing means by said display result comparing means determines a match.

10. The flipped ball game apparatus according to claim 1, wherein said specific operation means comprises informing means for informing that the display result of said variable display portion provides said specific state.

11. The flipped ball game apparatus according to claim 1, wherein, said specific operation means comprises specific variable display state control means for displaying and controlling said variable display portion still varying display so that the display result of said variable display portion provides a variable display state different from that of said specific state.

12. The flipped ball game apparatus according to claim 1, wherein said ball shooting means includes shooting force variably setting means capable of variably setting a shooting force to shoot a ball.

13. The flipped ball game apparatus according to claim 12, wherein said shooting force variably setting means includes first shooting force variably setting means for setting said shooting force after adjusting said shooting force in a relatively rough manner, and second shooting force variably setting means for setting said shooting force after adjusting said shooting force in a relatively fine manner.

14. The flipped ball game apparatus according to claim 13, wherein said first shooting force variably setting means includes an adjustment portion capable of adjusting the shooting force by manual operation, and shooting force fixing means for fixing the shooting force adjusted by the adjustment portion so as to avoid distortion of the shooting force.

15. The flipped ball game apparatus according to claim 13, wherein said second shooting force variably setting means includes an adjustment portion capable of adjusting the shooting force by manual operation, and shooting force fixing means for fixing the shooting force adjusted by the adjustment portion so as to avoid distortion of the shooting force.

16. The flipped ball game apparatus according to claim 1, wherein said starting condition determining means includes valuable object using operation determining means for determining that a predetermined operation for using a value of a predetermined valuable object in a game is carried out.

17. The flipped ball game apparatus according to claim 16, wherein said valuable object using operation determining means includes a valuable object receiving portion for receiving said valuable object, and valuable object reception detecting means for detecting reception of the valuable object into the valuable object receiving portion.

18. The flipped ball game apparatus according to claim 1, further comprising one-unit game allowing means for allowing a predetermined one-unit game by shooting balls within a predetermined number of balls into said play field by using a value necessary to play said one-unit game, said number of balls allowed to be shot in said one-unit game being predetermined.

19. The flipped ball game apparatus to claim 18, wherein said variable display controlling means draws and displays the display result of said variable display apparatus after the number of balls allowed to be shot by said one-unit game allowing means are shot by said ball shooting means.

20. The flipped ball game apparatus according to claim 18, wherein said one-unit game allowing means includes ball shooting detecting means for detecting shooting of a ball by said ball shooting means, counting means for counting the number of balls shot into said play field in accordance with the result of the detection by said ball shooting detecting means, and ball shooting stopping means for stopping shooting of the balls by said ball shooting means when a count value by said counting means reaches a value corresponding to said predetermined number of balls.

21. The flipped ball game apparatus according to claim 20, wherein said play field includes a winning zone into which the balls shot into the play field can fall to win and a lost ball port for collecting lost balls which are not fell into the winning zone, said apparatus further comprising winning value providing means for providing a value to the player when the balls fall into said winning zone, and wherein the winning value providing means includes remaining ball winning value providing means for providing a value in accordance with winning of remaining balls when the balls still remaining in said play field fall into said winning zone after shooting of the balls is stopped by said ball shooting stopping means.

22. The flipped ball game apparatus according to claim 21, wherein said remaining ball winning value proving means includes value provision prohibiting means after elapse of a predetermined period for prohibiting provision of a value in accordance with winning of said remaining balls fell into the winning zone when a predetermined period has elapsed after shooting of balls is stopped by said ball shooting stopping means.

23. The flipped ball game apparatus according to claim 21, wherein said variable display controlling means serves to draw and display the display result of said variable display apparatus after provision of the value is prohibited by said value provision prohibiting means after elapse of a predetermined period.

24. The flipped ball game apparatus according to claim 1, further comprising ball circulating and restoring means for collecting the balls shot into said play field by said ball shooting means and supplying those balls to said ball shooting means again so that those balls can be re-shot.

25. The flipped ball game apparatus according to claim 18, further comprising value storing means for storing in advance a value of said valuable object for use in a game, and game repetition allowing means for allowing repetition of said one-unit game with satisfaction of allowing conditions satisfied under such a necessary condition that the remaining value stored in said value storing means is equal to or higher than the value necessary to play said one-unit game, said one-unit game being played by using the value stored in the value storing means.

26. The flipped ball game apparatus according to claim 18, further comprising game result output means for visibly outputting, after said one-unit game is played a plural times, information relating to a game result of such a one-unit game that is played before current one-unit game.

27. The flipped ball game apparatus according to claim 26, further comprising one-unit game allowing means for allowing a predetermined one-unit game by shooting balls within a predetermined number of balls into said play field by using the value necessary to play said one-unit game, said number of balls allowed to be shot in said one-unit game being predetermined, value storing means for storing in advance the value of said valuable object for use in a game, and game repetition allowing means for allowing repetition of said one-unit game with satisfaction of allowing conditions satisfied under such a necessary condition that the remaining value stored in the value storing means is equal to or higher than the value necessary to play said one-unit game, said one-unit game being played by using the value stored in said value storing means, wherein said game result output means includes stored value output means for outputting the value stored in said value storing means at such a one-unit game that is played before current one-unit game.

28. The flipped ball apparatus according to claim 26, further comprising one-unit game allowing means for allowing a predetermined one-unit game by shooting balls within a predetermined number of balls into said play field by using the value necessary to play said one-unit game, said number of balls allowed to be shot in said one-unit game being predetermined, and game result value storing means for storing a game result value which is provided to the player as a result of said one-unit game, wherein said game result output means includes game result value output means for visibly outputting the value stored in said game result value storing means at such a one-unit game that is played before current one-unit game.

29. The flipped ball game apparatus according to claim 26, further comprising one-unit game allowing means for allowing a predetermined one-unit game by shooting balls within a predetermined number of balls into said play field by using the value necessary to play said one-unit game, said number of balls allowed to be shot in said one-unit game being predetermined, wherein said play field includes a winning zone into which balls can fall to win, and wherein said game result output means includes winning ball number output means for visibly outputting the number of winning balls fell into said winning zone at such a one-unit game that is played before current one-unit game.

30. The flipped ball game apparatus according to claim 24, wherein said ball circulating and restoring means includes a circulation passage for circulating balls and ball circulate/discharge switching means provided in a course of the circulation passage for switching from a circulation state in which the balls continues circulation to a discharge state in which the balls are discharged out of the machine.

31. The flipped ball game apparatus according to claim 30, further comprising ball discharge operating means for operating said ball circulate/discharge switching means to switch to the discharge state in which the balls are discharged out of the machine.

32. The flipped ball game apparatus according to claim 24, wherein said ball circulating and restoring means includes a circulation passage for circulating balls and contamination removing means provided in a course of the circulation passage for removing contamination adhered to the balls.

33. The flipped ball game apparatus according to claim 32, wherein said contamination removing means includes a ball polishing member abutted against a surface of a ball for polishing the ball surface.

34. The flipped ball game apparatus according to claim 1, further comprising bet number setting means for setting a bet number in a desired value for determining a dividend ratio of the value to be provided as the result of the game in accordance with operation of the player, and value providing means for providing the value as the result of the game, the providing ratio of said value being determined by the bet number set by said bet number setting means, wherein said ball shooting means shoots balls toward said play field by using the value of the predetermined valuable object, the usage ratio of the value of said valuable object used to shoot said balls being determined in accordance with the predetermined bet number.

35. The flipped ball game apparatus according to claim 34, further comprising bet number displaying means for displaying a bet number set by said bet number setting means.

36. The flipped ball game apparatus according to claim 34, wherein said bet number setting means includes a valuable object receiving portion for receiving said valuable object, value detecting means for detecting a magnitude of the value of the valuable object received in the valuable object receiving portion, and received value setting means for setting the value of the valuable object received in said valuable object receiving portion as a bet number in accordance with a detection result of the value detecting means.

37. The flipped ball game apparatus according to claim 34, further comprising one-unit game allowing means for allowing a predetermined one-unit game by shooting balls within a predetermined number of balls into said play field by using the value necessary to play said one-unit game, said number of balls allowed to be shot in said one-unit game being predetermined, value storing means for storing in advance the value of said valuable object for use in a game, and game repetition allowing means for allowing repetition of said one-unit game with satisfaction of allowing conditions satisfied under such a necessary condition that the remaining value stored in the value storing means is equal to or higher than the value necessary to play said one-unit game, said one-unit game being played by using the value stored in said value storing means, wherein said bet number setting means includes stored value drawing and setting means for drawing a part of the value stored in said value storing means for setting that value as said bet number.

38. The flipped ball game apparatus according to claim 34, further comprising one-unit game allowing means for allowing a predetermined one-unit game by shooting balls within a predetermined number of balls into said play field by using the value necessary to play said one-unit game, said number of balls allowed to be shot in said one-unit game being predetermined, wherein the number of balls allowed to be shot in said one-unit game is varied in response to the magnitude of the bet number set by said bet number setting means in the one-unit game allowing means.

39. The flipped ball game apparatus according to claim 34, wherein said one-unit game allowing means allows a relatively large number of balls to be shot when the bet number set by said bet number setting means is relatively large, and allows a relatively small number of balls to be shot when the bet number set by said bet number setting means is relatively small.

* * * * *